US006877996B1

(12) United States Patent
Franks, Jr.

(10) Patent No.: US 6,877,996 B1
(45) Date of Patent: Apr. 12, 2005

(54) GROUNDING CONNECTOR

(75) Inventor: George J. Franks, Jr., Inverness, IL (US)

(73) Assignee: Senior Industries, Inc., Wood Dale, IL (US)

( * ) Notice: Subject to any disclaimer, the term of this patent is extended or adjusted under 35 U.S.C. 154(b) by 0 days.

(21) Appl. No.: 10/417,306

(22) Filed: Apr. 14, 2003

Related U.S. Application Data

(63) Continuation-in-part of application No. 10/319,106, filed on Dec. 13, 2002, now abandoned, which is a continuation-in-part of application No. 10/307,114, filed on Nov. 27, 2002.

(51) Int. Cl.[7] ..... H01R 13/648

(52) U.S. Cl. ..... 439/92; 439/782; 439/812

(58) Field of Search ..... 439/92–100, 810–815, 439/781, 782, 225, 582, 939, 551, 101, 803, 579, 791; 174/40 CC, 51

(56) References Cited

U.S. PATENT DOCUMENTS

| | | | |
|---|---|---|---|
| 63,848 | A | 4/1867 | Bruso |
| 106,900 | A | 8/1870 | Wharton |
| 759,414 | A | 5/1904 | Bishop |
| 926,030 | A | 6/1909 | Stout |
| 933,311 | A | 9/1909 | Klein |
| 982,995 | A | 1/1911 | Rogers |
| 1,205,374 | A | 11/1916 | Marcus |
| 1,210,764 | A | 1/1917 | Cole |
| 1,349,225 | A | 8/1920 | Rosenblum |
| 1,408,301 | A | 2/1922 | Jeter |
| 1,486,560 | A | 3/1924 | Becker |
| 1,540,249 | A | 6/1925 | Brown |
| 1,552,932 | A | 9/1925 | Kessler |
| 1,597,169 | A | 8/1926 | Taylor |
| 1,652,191 | A | 12/1927 | Withers |

(Continued)

FOREIGN PATENT DOCUMENTS

| | | |
|---|---|---|
| CA | 603254 | 8/1960 |
| CA | 968431 | 5/1975 |
| DE | 1132999 | 7/1962 |
| DE | 2108227 | 9/1972 |
| DE | 2741791 | 7/1978 |
| DE | 2713247 | 9/1978 |
| DE | 147294 | 3/1981 |
| FR | 1126748 | 11/1956 |
| GB | 1085499 | 10/1967 |
| GB | 1159264 | 7/1969 |
| GB | 2195837 A | 4/1988 |
| SE | 161707 | 12/1957 |

OTHER PUBLICATIONS

Arthur Trauffer, "Snap–On Ground Clamp", *Radio & Television News,* Feb. 1954 (1 page).

Senior Industries, Inc. product literature entitled "Meter Box Ground Clamp" (date prior to Nov. 27, 2001) (1 page).

(Continued)

*Primary Examiner*—Ross Gushi

(74) *Attorney, Agent, or Firm*—Bell, Boyd & Lloyd LLC

(57) ABSTRACT

A grounding connector with an improved ground terminal that facilitates easy ground wire attachment. The grounding connector includes a base that locates the ground terminal so that the ground terminal can operate between a wire receiving position and a wire engaging position without interference from the structure to which the connector is attached. The ground terminal includes a bracket having at least one guide and an actuator to move the bracket between the wire receiving and wire engaging positions. The guide of the bracket is received by a guide aperture in the base to guide the movement of the bracket. The bracket also defines relatively large ground wire receiving apertures that are exposed for receiving a ground wire when the bracket is in the wire receiving position. Once a grounding wire is inserted into the apertures, the bracket is actuated to its wire engaging position, and the wire is clamped against the connector.

21 Claims, 12 Drawing Sheets

U.S. PATENT DOCUMENTS 1,675,163 A 6/1928 Colburn
1,690,220 A 11/1928 Fahnestock
1,727,219 A 9/1929 Scharf et al.
1,794,976 A 3/1931 Mueller
1,810,901 A 6/1931 Bormann et al.
1,813,448 A 7/1931 Horton
1,910,022 A 5/1933 Legg
1,941,905 A 1/1934 Mair
1,986,028 A 1/1935 Terry
1,997,091 A 4/1935 Usselman
2,040,438 A 5/1936 Johnson
2,107,835 A 2/1938 Pierce
2,260,136 A 10/1941 Bergan
2,270,807 A 1/1942 Johnson
2,299,146 A 10/1942 Hubbard
2,420,895 A 5/1947 Merriman
2,423,627 A 7/1947 Tinnerman
2,458,413 A 1/1949 Pennell
2,529,153 A 11/1950 Hain
2,532,068 A 11/1950 Larsen
2,547,932 A 4/1951 Downs, Jr.
2,632,068 A 3/1953 Froebel et al.
2,710,381 A 6/1955 Monson
2,733,492 A 2/1956 Copell
2,811,704 A 10/1957 Newman
2,831,222 A 4/1958 Anderson
2,948,940 A 8/1960 Degener
2,970,287 A 1/1961 Gill
3,021,581 A 2/1962 Cook et al.
3,068,445 A * 12/1962 Crowther ..... 439/782
D197,417 S 1/1964 Kirkpatrick
3,129,994 A 4/1964 Harmon et al.
3,166,632 A 1/1965 Woodman
3,188,602 A 6/1965 Toedtman et al.
3,260,986 A 7/1966 Staffel
3,363,219 A 1/1968 Hubbard et al.
3,363,310 A 1/1968 Stinson, Jr.
3,435,126 A 3/1969 Hamilton
3,528,050 A 9/1970 Hindenburg
3,568,128 A 3/1971 Taylor
3,694,794 A 9/1972 Hein
3,760,341 A 9/1973 Grad
3,781,757 A 12/1973 Barnes
3,850,490 A 11/1974 Zehr
3,914,001 A 10/1975 Nelson et al.
D243,404 S 2/1977 Mooney et al.
4,014,504 A 3/1977 Sachs
4,325,598 A 4/1982 Leonardo
4,355,852 A 10/1982 Bachle
4,440,374 A 4/1984 Achille
4,461,521 A 7/1984 Sachs
4,476,759 A 10/1984 Aderneck
4,526,428 A 7/1985 Sachs
4,529,261 A 7/1985 Stenz et al.
4,538,879 A 9/1985 Wagener
4,591,229 A 5/1986 Sachs
4,626,051 A 12/1986 Franks, Jr.
4,664,469 A 5/1987 Sachs
4,742,981 A 5/1988 Converse
D296,545 S 7/1988 Sachs
D296,546 S 7/1988 Sachs
D296,547 S 7/1988 Sachs
D297,410 S 8/1988 Sachs
4,768,963 A 9/1988 Barron
4,776,808 A 10/1988 Davidson
4,778,413 A 10/1988 Saarinen
4,780,096 A 10/1988 Franks, Jr.
4,784,621 A 11/1988 Auclair
4,828,504 A 5/1989 Franks, Jr.
4,884,976 A 12/1989 Franks, Jr.
4,904,193 A 2/1990 Graves
4,917,615 A 4/1990 Franks, Jr.
4,925,395 A 5/1990 Franks, Jr.
D312,038 S 11/1990 Sachs
4,973,259 A 11/1990 Sachs
D313,392 S 1/1991 Sachs
4,993,960 A 2/1991 Franks, Jr.
5,006,074 A 4/1991 Franks, Jr.
5,015,205 A 5/1991 Franks, Jr.
D323,973 S 2/1992 Sachs
5,114,354 A 5/1992 Franks, Jr.
D329,014 S 9/1992 Sachs
D335,079 S 4/1993 Sachs
D340,226 S 10/1993 Sachs
D343,385 S 1/1994 Sachs
D344,886 S 3/1994 Sachs
D351,825 S 10/1994 Sachs
5,370,345 A 12/1994 Condon
D357,400 S 4/1995 Sachs
D362,174 S 9/1995 Sachs
D364,332 S 11/1995 Sachs
D367,259 S 2/1996 Sachs
D369,780 S 5/1996 Sachs
5,681,191 A 10/1997 Robicheau et al.
5,746,609 A 5/1998 Franks, Jr.
D395,997 S 7/1998 Coll et al.
D406,813 S 3/1999 Coll et al.
5,928,006 A 7/1999 Franks, Jr.
6,252,166 B1 6/2001 Leschinger
6,283,771 B1 9/2001 Mitchell et al.
D459,302 S 6/2002 Malin
D459,304 S 6/2002 Malin
D459,305 S 6/2002 Malin
D459,306 S 6/2002 Malin
D486,791 S 2/2004 Franks, Jr.
D487,427 S 3/2004 Franks, Jr.

OTHER PUBLICATIONS

Senior Industries, Inc. product literature entitled "2 New Ground Clamp Systems" (date prior to Nov. 27, 2001) (1 page).

Senior Industries, Inc. product literature entitled "Structure Ground Clamps" (date prior to Nov. 27, 2001) (1 page).

Senior Industries, Inc. product literature entitled "Bonding Ribbon Clamps" (date prior to Nov. 27, 2001) (1 page).

Senior Industries, Inc. product literature entitled "Grounding Connectors" (date prior to Nov. 27, 2001) (1 page).

Senior Industries, Inc. product literature for clamps and connectors (date prior to Nov. 27, 2001) (2 pages).

Senior Industries, Inc. product literature entitled "Universal Ground Clamp" (date prior to Nov. 27, 2001) (1 page).

Senior Industries, Inc. product literature entitled "B Strand Ground Clamp, Beam Clamp, B Ground Wire Clamp" (date prior to Nov. 27, 2001) (1 page).

Thomas & Betts product brochure entitled "T&B Telecommunications 40–2000X Grounding Clamp" (1998) (3 pages).

Diamond Communication Products, Inc. product brochure entitled "Meter Box Ground Clamp" (date prior to Nov. 27, 2001) (1 page).

Sachs Canada, Inc. product literature entitled "SaxInfo Industry & Product News" (date prior to Nov. 27, 2001) (1 page).

Sachs Canada, Inc. product literature entitled "SC51–1 Application Procedures" (date prior to Nov. 27, 2001) (1 page).

Sachs Communications, Inc. product literature entitled "SC51–1 Application Procedures" (date prior to Nov. 27, 2001) (1 page).
Sachs Canada, Inc. product literature entitled "SC51–2SS Application Procedures" (date prior to Nov. 27, 2001) (1 page).
Sachs Canada, Inc. product brochure entitled "SC51–2SS Application Procedures" (date prior to Nov. 27, 2001) (1 page).
Diamond/Sachs Communications Inc. product literature entitled "SC51CF–81 Application Procedures" (date prior to Nov. 27, 2001) (1 page).
Diamond/Sachs Communications Inc. product literature entitled "SC51CF–85 Application Procedures" (date prior to Nov. 27, 2001) (1 page).
Sachs Communications Inc. product literature entitled "Bonding Connector" (date prior to Nov. 27, 2001) (1 page).
Allied Bolt, Inc. product brochure entitled "Drop Wire Hardware", (1998) (1 pages).
Allied Bolt, Inc. product literature entitled "Grounding Hardware" (date prior to Nov. 27, 2001) (1 page).
Arris Telewire Supply product literature for Monarch Grounding Products (undated) (1 page).
Holland Electronics LLC product brochure entitled "Connectors" (2002) (1 page).
Sachs Canada Inc. product literature entitled "Grounding & Bonding" (1991) (pages GB1 and GB2).
Sachs Canada Inc. product literature entitled "Up Grading Additional Outlets" (1991) (1 page).
Sachs Canada Inc. product literature entitled "SC42 Bonding Connector Application" (1991) (1 page).
Sachs Canada Inc. product literature entitled "SaxInfo Industry and Product News" for "SC42–Ground Connector" (date prior to Nov. 27, 2001) (1 page).
Sachs Canada Inc. product literature entitled "Bonding Cable & Equipment at Pedestal" (1991) (1 page).
Sachs Canada Inc. product literature entitled "Bonding Connection at Meter Pan" (1991) (1 page).
Sachs Canada Inc. product brochure entitled "SC51–1 Application Sheet" (date prior to Nov. 27, 2001) (1 page).
Sachs product brochure entitled "SC51–2SS Application Procedures" (date prior to Nov. 27, 2001) (1 page).
Sachs Canada Inc. product literature entitled "SC13 Series Ground Strap Application" (1991) (1 page).
Sachs product literature entitled "SC13BZ–4 Application Procedures" (date prior to Nov. 27, 2001) (2 pages).
Sachs Canada Inc. product literature entitled "Grounding Customer Drops" (1991) (1 page).
Thomas & Betts "Product Handbook" (1998) (pp. cover page, 66, 67, 71–89, 126, 127, 142, 143).
Sachs Communications Product Book (1995) (pp. cover, 30–33, 40, 41, 44–47, 56–59, 70, 71, 76–79, 82, 83 and 86–90).
Peter J. Schram, *The National Electric Code Handbook,* Third Edition (1984), p. 195, National Fire Protection Association, Quincy, Massachusetts.

* cited by examiner

GROUNDING CONNECTOR

CROSS-REFERENCE TO RELATED APPLICATION

This application is a continuation-in-part of application Ser. No. 10/319,106, filed on Dec. 13, 2002, now abandoned which was a continuation-in-part of application Ser. No. 10/307,114, filed on Nov. 27, 2002.

FIELD OF THE INVENTION

The present invention relates to grounding connectors, and, more particularly, to grounding connectors using a wire ground terminal.

BACKGROUND OF THE INVENTION

Electrical signal-type distribution cables, such as those for telecommunications, cable television, and internet services, are often located in a right-of-way relatively near a commercial or residential building. Such a right-of-way is generally located along an adjacent municipal street or along the back of the residential or commercial lot near the property line. Similarly, satellite distribution equipment is often mounted on the building, such as on the roof or a wall, or is located adjacent to the building on a separate support structure. Either distribution system is located outside of the building and does not directly enter the building. Thus, the building includes the internal wiring of the system, which distributes the electrical signal or transmission, such as telecommunications, cable television, internet, or satellite service, throughout the structure. Therefore, there generally is an interconnection between the distribution system bringing the service to the building and the internal wiring which transmits the service into and throughout the building.

Due to differences between the external delivery system and the internal wiring of the structure, there may be a voltage build-up within the interconnection between the two. A voltage build-up can have undesirable effects, such as the potential to cause damage to equipment and users and signal interference in the transmitted signal. In order to minimize undesirable voltage build-up, it is common for the connection interface to be grounded by wiring it to a grounding mechanism, such as a grounding post sunk into the ground, a grounded utility box, or a cold water pipe inside the structure. A grounding post, whether it is part of a grounded utility box or a separate object, is typically sunk six feet or more in length into the ground and is located within a few feet of or in close proximity to the base of the building and the utility and cable interconnections.

A traditional connection interface includes a grounding connector that contains the necessary hardware to complete the grounded interconnection, such as a telephone switching box, cable "F" series connector, or other type of interconnector, and a connection for a grounding wire. The grounding connector typically includes a screw-type ground wire terminal. The grounding connector electrically connects the interconnection and the ground terminal screw, and a grounding wire is connected to the ground terminal screw. The grounding wire is connected to the grounding connector by wrapping it around the ground terminal screw and clamped in place by the head of the screw. The opposite end of the grounding wire is then connected to a grounding mechanism, such as a grounding post sunk into the ground, a grounded utility box fitted with a ground terminal, a clamp having a ground terminal that is electrically attached to the utility box, or a cold water pipe within the building. The grounding connector itself is generally attached to the side of the building near the location of the interconnection and the grounding mechanism.

This traditional arrangement has several shortcomings. Grounding connectors typically use a ground terminal screw to connect the grounding wire to the connector. A technician is required to wind the grounding wire around the ground terminal screw and then secure the wire under the head of the screw by turning the screw with a screwdriver, socket wrench, or other appropriate tool. The screw then holds the wire in place and the other end of the grounding wire is connected to a grounding mechanism, such as a grounding post, a grounded utility box, a clamp having a ground terminal that is electrically attached to the utility box, or a cold water pipe, to electrically ground the connector and cable interconnection.

The process of winding the grounding wire around the screw and then closing the screw is often more complicated than expected. The technician is required to carefully wind the wire tightly around the screw, so that it does not become loose over time. Wrapping the ground wire around the screw tends to be difficult, particularly if, as often is the case, the ground wire is made of heavy gauge wire, such as a 6-gauge wire. Heavy gauge wires are stiff and, therefore, are difficult to bend, particularly around an object with a small diameter such as a screw. Finally, if the technician fails to wind the ground wire around the screw tightly enough and for the required number of revolutions for any of the above reasons, the ground wire may "walk" or slide out from beneath the head of the screw as the screw is being tightened, compromising the grounding connection. Moreover, this difficulty is compounded if the technician is working alone, standing on a ladder, or is suspended from the building which is often the case.

DETAILED DESCRIPTION OF THE PREFERRED EMBODIMENT(S)

Figure 1:
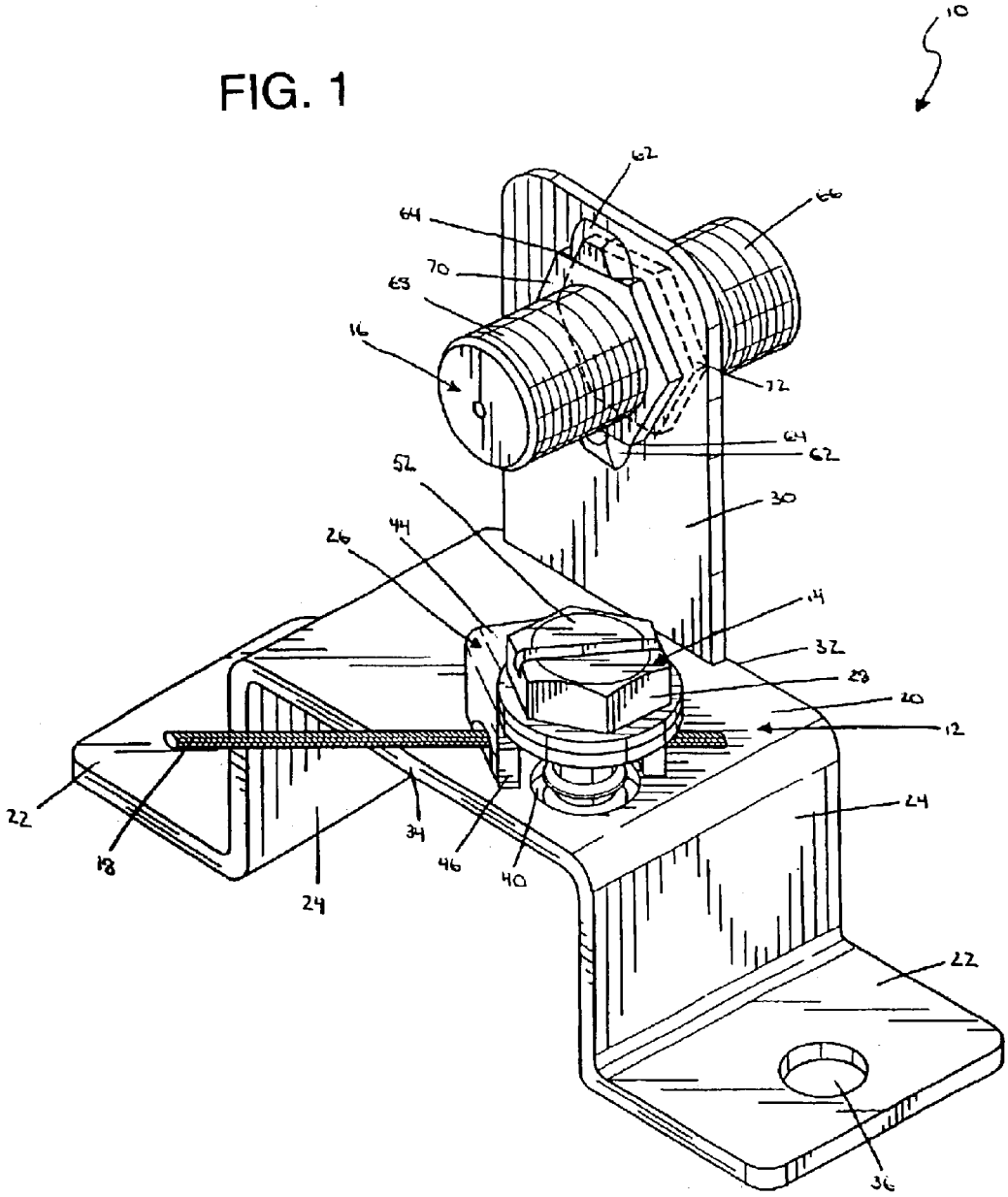
FIG. 1 is a perspective view of a grounding connector embodying features of the present invention.

Referring to FIG. 1, there is illustrated a grounding connector 10 embodying features of the present invention. The grounding connector 10 includes a base 12 that supports a ground terminal 14 and an interconnection 16. The ground terminal 14 is designed to efficiently and effectively receive and clamp a grounding wire 18 to the grounding connector 10 to form an electrical connection to ground the connector 10. The grounding wire 18 is then attached to any suitable grounding mechanism, such as a ground rod, grounded utility box, or water pipe. The grounding connector 10 may be made of any suitable conductive material, and thus, the interconnector 16 is grounded along with the grounding connector 10. The interconnector 16 permits cables to be interconnected at the grounding connector 10.

Figure 2:
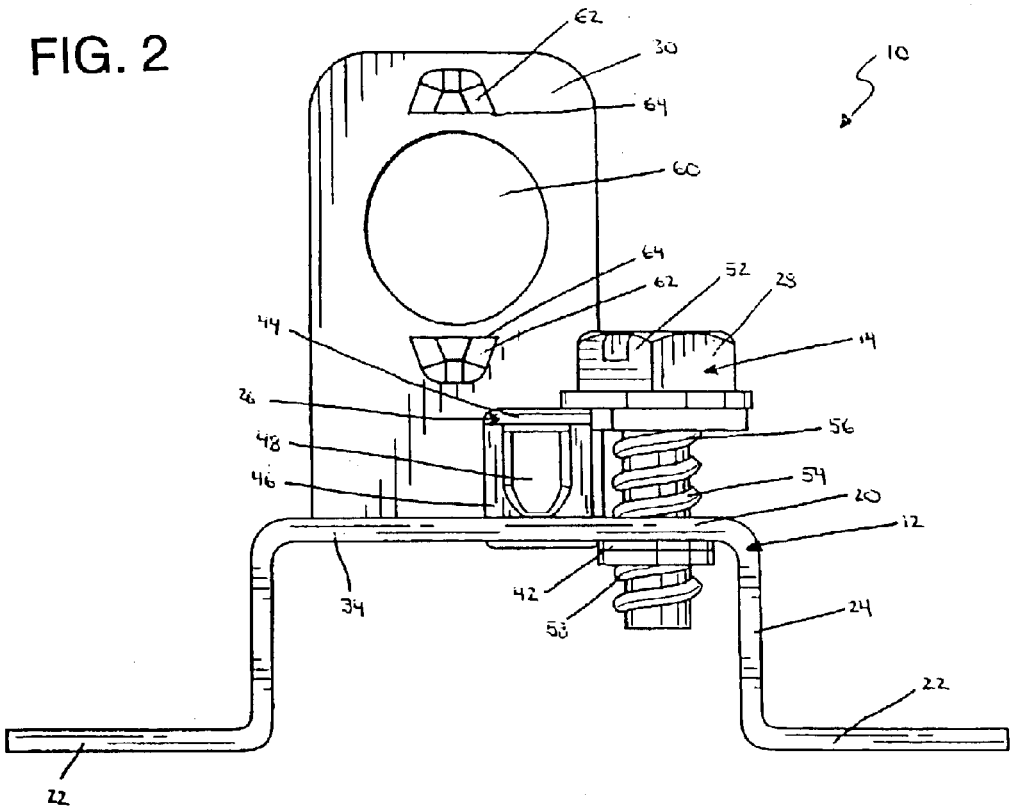
FIG. 2 is a side elevational view of the grounding connector of FIG. 1.
Figure 3:
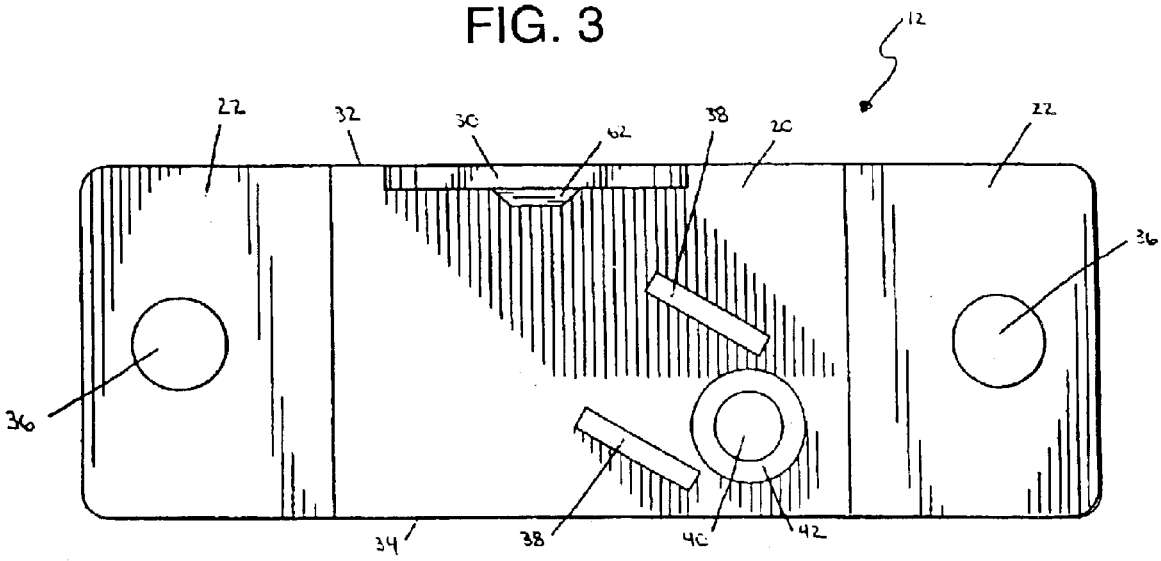
FIG. 3 is a plan view of the base of the grounding connector of FIG. 1.
Figure 4:
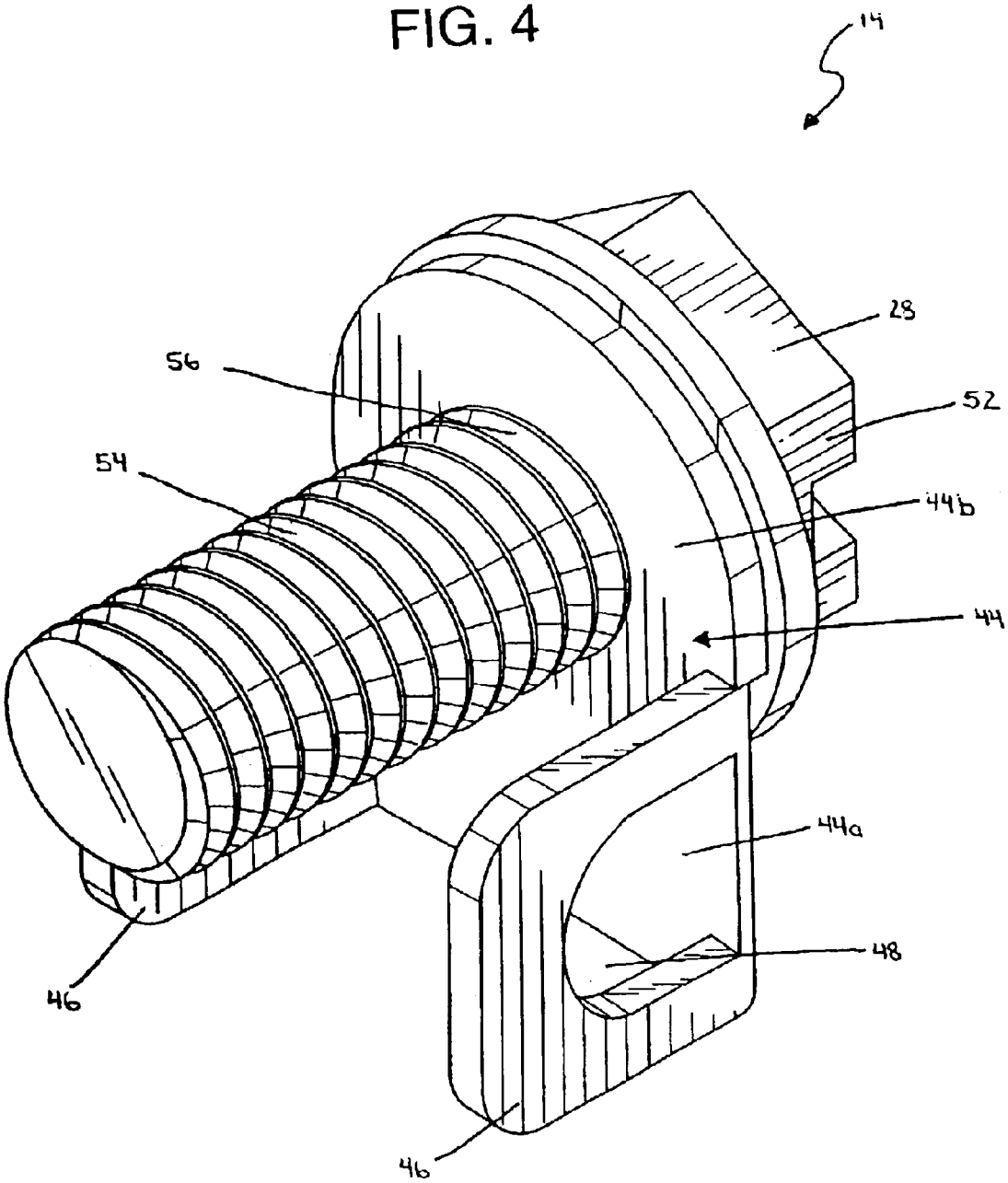
FIG. 4 is a perspective view of the ground terminal of the grounding connector of FIG. 1.
Figure 5:
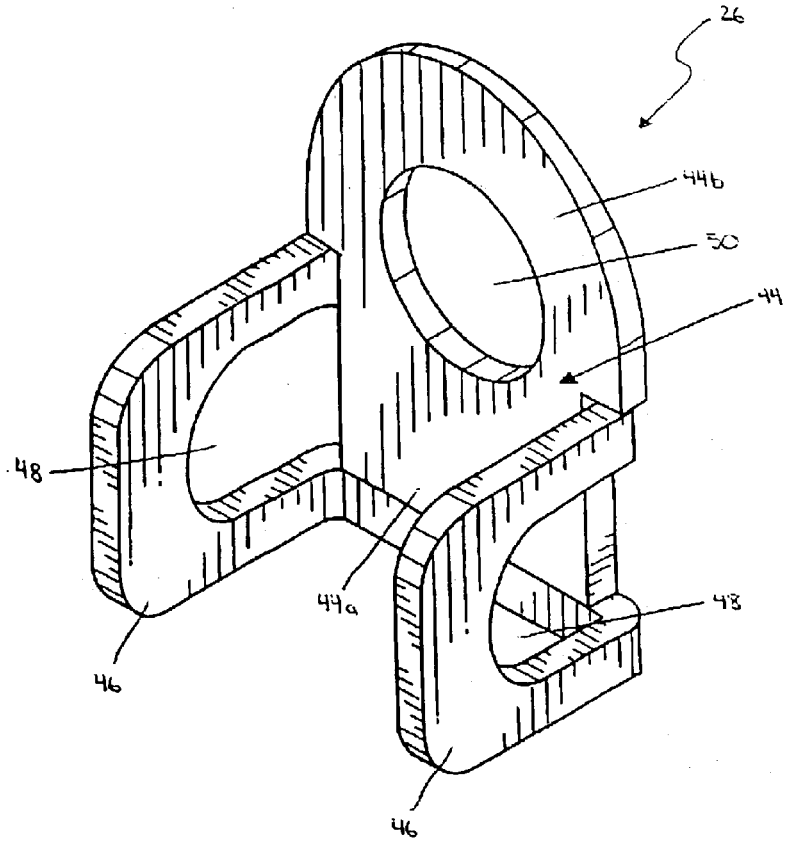
FIG. 5 is a perspective view of the ground bracket of the ground terminal of FIG. 4.
Figure 6:
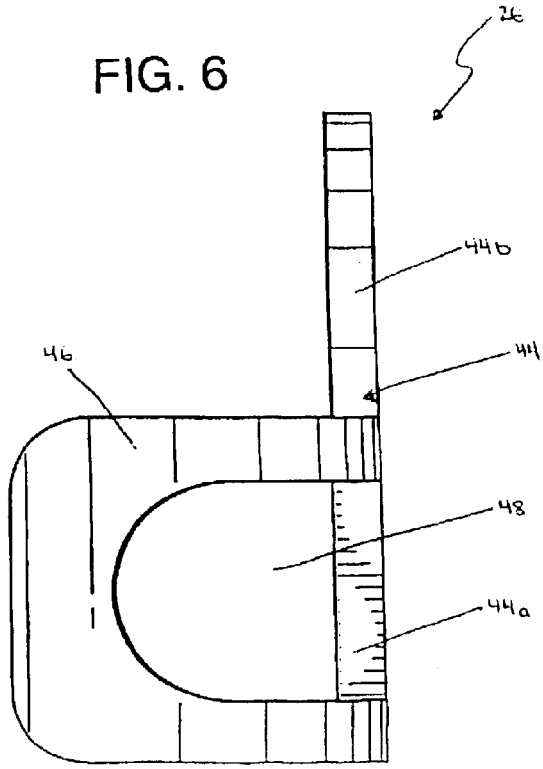
FIG. 6 is a side elevational view of the ground bracket of FIG. 5.

Turning to FIGS. 2 and 3, the base 12 includes a support platform 20 and a pair of mounting tabs 22. A pair of spacers 24 interconnect the mounting tabs 22 and the support platform 20. The support platform 20 supports and cooperates with the ground terminal 14 to secure the grounding wire 18. The ground terminal 14 includes a bracket 26 and an actuator 28 to move the bracket 26 between a wire receiving position and a wire clamping position. The spacers 24 are designed to provide room for the ground terminal 14 to operate effectively when shifting between the wire receiving position and the wire clamping position. The base 12 also supports a tab 30, which, in turn, supports the interconnector 16. The tab 30 spaces the interconnector 16 from the base 12 a sufficient distance to facilitate efficient and effective attachment of cables, such as coaxial cables, to the interconnector 16.

As illustrated in FIGS. 2 and 3, the support platform 20, the mounting tabs 22, the spacers 24, and the upstanding tab 30 are generally rectangular planar members. The support platform 20 extends generally parallel to the mounting tabs 22, and the spacers 24 extend generally ninety (90) degrees to the support platform 20 and the mounting tabs 22. The support platform 20 also includes a pair of elongated edges 32 and 34. The upstanding tab 30 extends along one of the elongated edges 32 adjacent to the corner formed with the transition to one of the spacers 24 and extends at generally ninety (90) degrees to the support platform 20. The base 12 is made from any suitable electrically conductive material, such as 0.050" stiff temper brass.

The mounting tabs 22 define anchor holes 36 that are used to attach the grounding connector 10 to a wall of a building or any other convenient structure, preferably a generally flat portion of a structure located near both the cable interconnection and the grounding mechanism. The holes 36 can receive any appropriate fastener, such as a screw, bolt, nail, staple, or rivet. The mounting tabs 22 are sized and the holes 36 are spaced from the spacers 24 so as to provide ample room to allow convenient use of an appropriate tool with the fastener.

As mentioned above, the support platform 20 cooperates with the ground terminal 14 to attach an appropriate ground wire. The support platform 20 defines a pair of elongated guide apertures 38. The guide apertures 38 are spaced from one another and run parallel to one another. Further, the guide apertures 38 are generally rectangular in shape and are set at a predetermined angle relative to the elongated edge 34 of the support platform 20 so as to angle back toward the tab 30 for the interconnector 16. For example, the angle could be thirty (30) degrees. This angled configuration facilitates the association of the wire 18 with the ground terminal 14 and the operation of the ground terminal 14. The support platform 20 also defines a circular aperture 40 partially between the guide apertures 38. The aperture 40 may be fitted with a threaded bushing 42 to cooperate with the actuator 28 when in the form of a screw or bolt. The guide apertures 38 and the circular aperture 40 are located generally in the corner formed between the elongated edge 34 of the platform 20 and the transition to the spacer 24. This location spaces the ground terminal 14 from the interconnector 16 and supporting tab 30 a sufficient distance to facilitate effective and efficient operation of the ground terminal 14.

As previously mentioned, the ground terminal 14 includes the bracket 26 and the actuator 28. With reference to FIGS. 2 and 4–6, the bracket 26 includes a generally planar bridge 44 with a generally square portion 44*a* and an arcuate portion 44*b*. The bracket 26 also includes a pair of guides 46 interconnected by the generally square portion 44*a* of the bracket 26. The guides 46 extend from opposite edges of the square portion 44*a* and are generally ninety (90) degrees to the square portion 44*a*. Each guide 46 defines a U-shaped aperture 48 that is designed sufficiently larger than the desired wire to facilitate easy receipt of a ground wire. The U-shaped apertures 48 are aligned so that the ground wire 18 can readily pass through both.

The arcuate portion 44*b* of the bracket 26 defines a circular aperture 50 through which the actuator 28 extends. The arcuate portion 44*b* and the circular aperture 50 locate the actuator 28 so as not to be interfered with by a grounding wire extending through the U-shaped apertures 48. The illustrated actuator 28 is in the form of a bolt with a head portion 52 and a threaded shaft portion 54. The head portion 52 may include a hexagonal configuration and a slot for use with a variety of tools. Other devices, such as a thumbscrew or screw, including a sheet metal screw or machine screw, may be employed as the actuator 28, as well as other head configurations for use with different tools.

The head portion 52 engages one side of the arcuate portion 44*b* of the bridge 44 about the circular aperture 50, and the threaded shaft 54 extends through the circular aperture 50. To maintain the shaft 54 in the circular aperture 50 with the head portion 52 generally against the arcuate portion 44*b* of the bridge 44, one or more threads 56 adjacent the other side of the bridge 44 are deformed. With the diameter of the circular aperture 50 slightly larger than the diameter of the threaded shaft portion 54, the actuator 28 is able to rotate relatively freely in the aperture 50 without moving longitudinally relative to the bridge 44 because of the head portion 52 and the deformed threads 56. Further, threads 58 near the end of the threaded shaft portion 54 may be deformed as well to prevent the ground terminal 14 from becoming separated from the base 12. As a result, the grounding connector 10 becomes a one-piece captivated connector. The components of the ground terminal 14 may be made from any suitable electrically conductive material, such as 0.045" stiff temper brass.

Alternatively, the head portion 52 of the actuator 28 is cold formed and the remaining shaft portion for the actuator 28 is inserted through the circular aperture 50. Threads are then formed on the shaft portion to form the threaded shaft 54. The threading is not done on the shaft portion extending through the aperture and is larger in diameter than the circular aperture 50. Thus, the threaded shaft 54 is allowed to rotate relatively freely in the aperture 50, and the threading prohibits the actuator 28 from moving longitudinally relative to the bridge 44.

Figure 7:
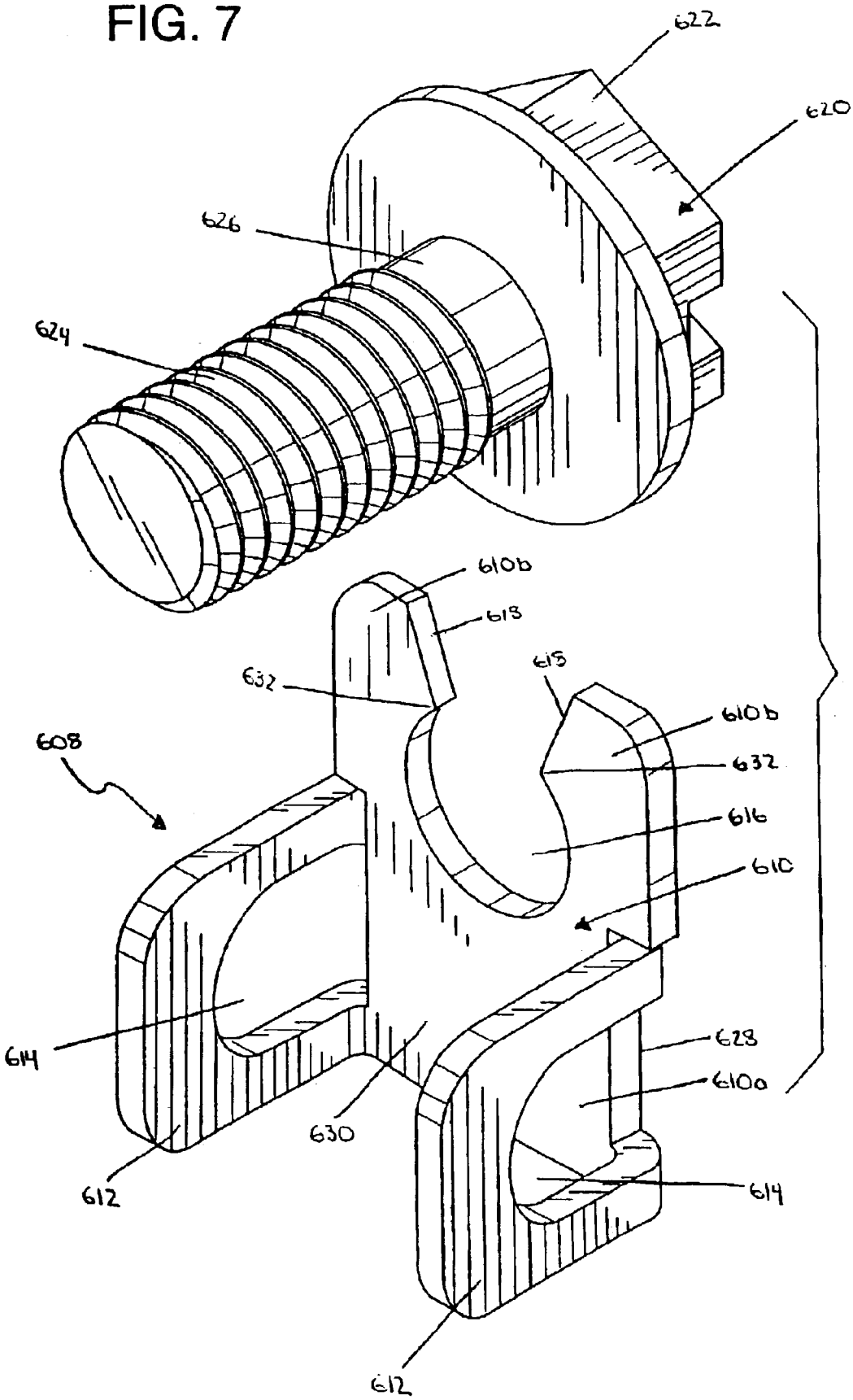
FIG. 7 is an exploded perspective view of an alternate ground bracket.

In another alternative form, as shown in FIG. 7, the bracket 608 includes a generally planar bridge 610 with a generally square portion 610*a* and a forked portion 610*b*. The bracket 608 also includes a pair of guides 612 interconnected by the generally square portion 610*a* of the bracket 608. The guides 612 extend from opposite edges of the square portion 610*a* and are generally ninety (90) degrees to the square portion 610*a*. Each guide 612 defines a U-shaped aperture 614 that is designed sufficiently larger than the desired ground wire to facilitate easy receipt of such wire. The U-shaped apertures 614 are aligned so that the ground wire can readily pass through both.

The forked portion 610*b* of the bracket 608 defines slot with a circular portion 616 and a tapered passage 618. The tapered passage 618 leads to the circular portion 616 and opens opposite the square portion 610*a* of the bridge 610. The intersection of the tapered portion 618 and the circular portion 616 forms a neck 632. The forked portion 610*b*, and the circular portion 616 of the slot locate the actuator 620 so as not to be interfered with by a grounding wire extending through the U-shaped apertures 614.

The illustrated actuator 620 is in the form of a bolt with a head portion 622 and a threaded shaft portion 624. The head portion 622 may include a hexagonal configuration and a slot for use with a variety of tools. The actuator 620 also includes an unthreaded portion 626 located between the head portion 622 and the threaded shaft portion 624. The unthreaded portion 626 has a diameter slightly smaller than the threaded shaft portion 624. Other devices, such as a thumbscrew or screw, including a sheet metal screw or machine screw, may be formed with the unthreaded portion 626 adjacent the head portion 622 and be employed as the actuator 620, as well as other head configurations for use with different tools.

To assemble the ground terminal 14, the unthreaded portion 626 is inserted into the tapered portion 618 and is moved toward the circular portion 616. The edges of the tapered portion 618 guide the movement for installation of the actuator 620 to the neck 632. The unthreaded portion 626 forces the tapered portion 618 to expand outward, which in turn allows the unthreaded portion 626 to snap through the neck 632 into place within the circular portion 616. The unthreaded portion 626 is maintained laterally in the circular portion 616 by the neck 632. The head portion 622 engages one side of the forked portion 610*b* of the bridge 610 about the circular aperture 616 and the unthreaded portion 626 extends through the circular aperture 616 for free rotation. The threaded shaft portion 624 and the head portion 622 of the actuator 620 maintain longitudinally the unthreaded portion 626 in the circular aperture 616. The head portion 622 is generally against a first side 628 of the forked portion 610*b* of the bridge 610 and the threaded shaft portion 624 is generally against a second side 630 of the forked portion 610*b*.

More specifically, with the diameter of the circular portion 616 slightly larger than the diameter of the unthreaded portion 626, the actuator 620 is able to rotate relatively freely in the aperture 616 without moving longitudinally relative to the bridge 610 because of the head portion 622 and the threaded shaft portion 624. Further, threads near the end of the threaded shaft portion 624 may be deformed after connection to the base 12 of the grounding connector 10 to prevent the ground terminal 14 from becoming separated from the base 12. As a result, the grounding connector 10 becomes a one-piece captivated connector. The components of the ground terminal 14 may be made from any suitable electrically conductive material, such as 0.045" stiff temper brass.

Figure 8:
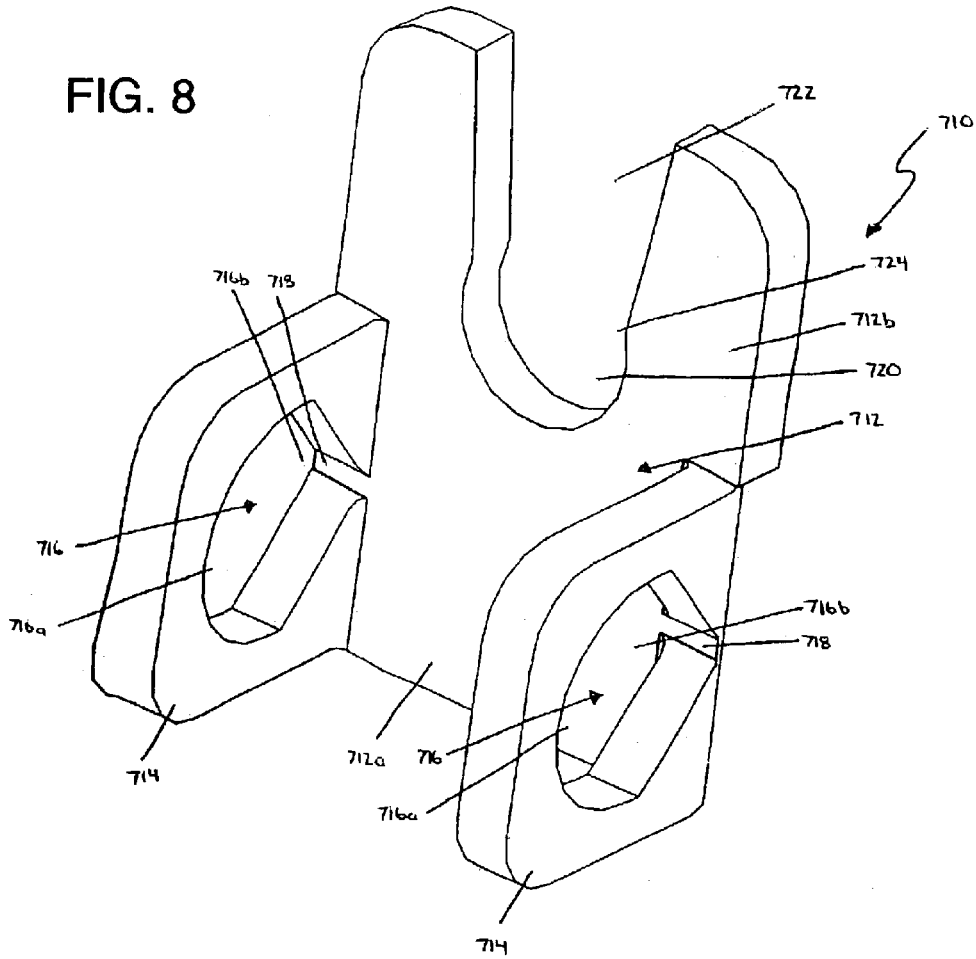
FIG. 8 is a perspective view of an alternate ground bracket.
Figure 9:
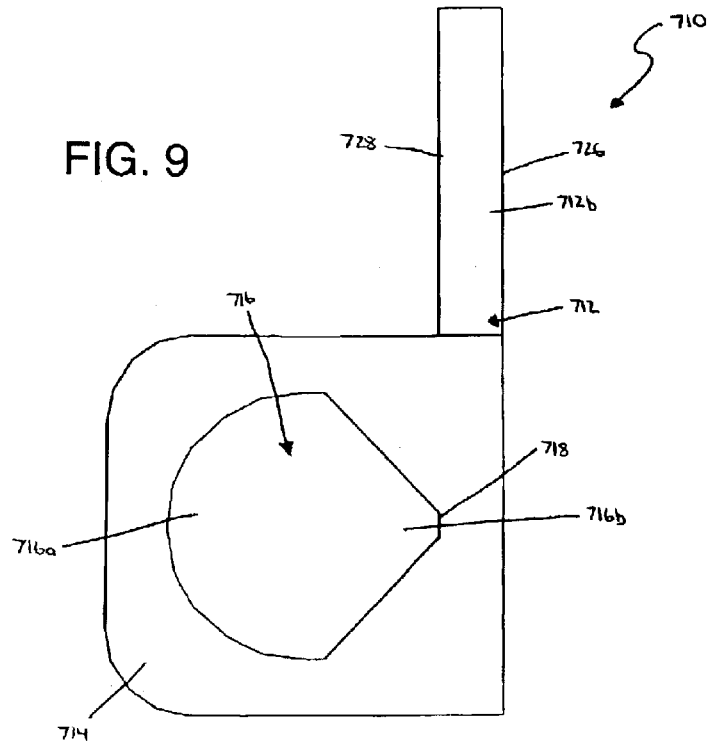
FIG. 9 is a side elevational view of the ground bracket of FIG. 8.

In yet another alternative form, as shown in FIGS. 8 and 9, the bracket 710 includes a generally planar bridge 712 with a generally square portion 712*a* and a forked portion 712*b*. The bracket 710 also includes a pair of guides 714 interconnected by the generally square portion 712*a* of the bracket 710. The guides 714 extend from opposite edges of the square portion 712*a* and are generally ninety (90) degrees to the square portion 712*b*. Each guide 714 defines an aperture 716 that is designed sufficiently larger than the desired ground wire to facilitate easy receipt of such wire.

More specifically, the aperture 716 includes a generally U-shaped portion 716*a* located opposite the planar bridge 712 and a generally V-shaped portion 716*b* generally adjacent the planar bridge 712. The U-shaped portion 716*a* and the V-shaped portion 716*b* intersect in generally the middle of the length of the guide 714. The V-shaped portion 716*b* may have a flattened base 718. The flattened base 718 may have various dimensions that maintain the V-shape of the V-shaped portion 716*b* but, preferably, has dimensions smaller than the diameter of a 14 gauge wire.

The V-shaped portion 716*b* of the aperture 716 is designed with dimensions such that the aperture 716 contacts the ground wire on each side of the ground wire. As such, the ground wire cannot move or pivot relative to the aperture 716 and the edges of the aperture 716 hold the ground wire under high pressure on both sides of the ground wire. The apertures 716 are aligned so that the ground wire can readily pass through both. Although in the present alternative form, the aperture 716 includes a generally U-shaped portion 716*a* and a generally V-shaped portion 716*b*, any shape that increases the pressure on the ground wire and discourages movement or pivoting of the ground wire while allowing the ground wire to be inserted with ease may be used.

In addition, the bracket may be formed with any additional structural features anywhere thereon that applies an increased pressure on the grounding wire. For example, the square portion 712*a* may have a portion that extends into the area between the guides 714. That is, the square portion 712*a* could be stamped to push a portion into the area between the guides 714. This portion engages the grounding wire to provide increased binding pressure on the wire.

The forked portion 712*b* of the bracket defines a slot with a circular portion 720 and a tapered passage 722. The tapered passage 722 leads to the circular portion 720 and opens opposite the square portion 712*a* of the bridge 712.

The intersection of the tapered passage 722 and the circular portion 720 forms a neck 724. The forked portion 712*b* and the circular portion 720 of the slot locate the actuator 620, as discussed above, so as not to be interfered with by a grounding wire extending through the aperture 716.

To assemble the ground terminal 14, the unthreaded portion 626 of the actuator 620 is inserted into the tapered passage 722 and is moved toward the circular portion 720. The edges of the tapered passage 722 guide the movement of the actuator 620 to the neck 724. The unthreaded portion 626 forces the tapered passage 722 to expand outward, which in turn allows the unthreaded portion 626 to snap through the neck 724 into place within the circular portion 720. The unthreaded portion 626 is maintained laterally in the circular portion 720 by the neck 724. The head portion 622 of the actuator 620 engages one side of the forked portion 712*b* of the bridge 712 about the circular aperture 616 and the unthreaded portion 626 extends though the circular aperture 616 for free rotation. The threaded shaft portion 624 and the head portion 622 of the actuator 620 maintain longitudinally the unthreaded portion 626 in the circular aperture 616. The head portion 622 is generally against a first side 726 of the forked portion 712*b* of the bridge 712 and the threaded shaft portion 624 is generally against a second side 728 of the forked portion 712*b*.

More specifically, with the diameter of the circular portion 720 slightly larger than the diameter of the unthreaded portion 626, the actuator 620 is able to rotate relatively freely in the circular aperture 616 without moving longitudinally relative to the bridge 712 because of the head portion 622 and the threaded shaft portion 624. Further, threads near the end of the threaded shaft portion 624 may be deformed after connection to the base 12 of the grounding connector 10 to prevent the ground terminal 14 from becoming separated from the base 12. As a result, the grounding connector 10 becomes a one-piece captivated connector. The components of the ground terminal 14 may be made from any suitable electrically conductive material, such as 0.045" stiff temper brass.

The guides 46 of the bracket 26 are received in the guide apertures 38 of the support platform 20 of the base 12. The clearance between the guides 46 and the guide apertures 38 is preferably only that needed to facilitate smooth movement of the guides 46 relative to the platform 20. The actuator 28 threads into the threaded bushing 42 mounted in the aperture 40 of the support platform 20. The actuator 28 extends only slightly beyond the guides 46 to accommodate the thickness of the bushing 42 and to allow most, if not all, of the U-shaped apertures 48 to be exposed to facilitate efficient and effective insertion of the ground wire 18 without release from the bushing 42.

On the other hand, the actuator 28 should not extend too far beyond the guides 46 in order to avoid undesired operation of the grounding connector 10. More specifically, the length of the spacers 24 of the base 12 is coordinated with the length of the actuator 28 and guides 46 so as to provide sufficient operating room between the support platform 20 and the structure to which the grounding connector 10 is attached. That is, for example, the actuator 28 is turned counter-clockwise to move the bridge 44 of the bracket 26 away from the support platform 20 to expose the U-shaped apertures 48 for receiving the grounding wire 18 and is turned clockwise to move the bridge 44 of the bracket 26 toward the support platform 20 to ultimately clamp the grounding wire 18 securely between the bridge 44 and the support platform 20. The spacers 24 should be long enough to allow the actuator 28 to both expose the U-shaped apertures 48 and to securely clamp a wire without contacting the structure to which the grounding connector 10 is attached. Contact with the supporting structure could cause damage to the grounding connector 10 and could cause the attachment of the grounding connector 10 to the structure to be compromised. Additionally, it is preferable to minimize the overall height of the ground terminal 14 so as to produce a "low-profile" grounding connector 10 which minimizes the potential for breakage of the ground terminal 14 when struck by an object after installation.

As mentioned above, the base 12 supports the tab 30, which, in turn, supports the interconnector 16. As shown in FIGS. 1 and 2, the tab 30 also includes a pair of projections 62 with surfaces 64 for engaging the interconnector 16 to assist in the installation of the interconnector 16 at the tab 30 and in the attachment of cables to be interconnected at the grounding connector 10.

For example, the interconnector 16 may be an "F" series connector commonly used to interconnect coaxial cables. An F-connector commonly includes two back-to-back threaded shaft portions 66 and 68 with female ends to cooperate with common connectors fixed on the ends of coaxial cables. These threaded portions 66 and 68 are separated by a hexagonal flange 70. One of the threaded portions 66 extends through the aperture 60 of the tab 30 and is secured at the aperture 60 with a nut 72. To prevent the F-connector from rotating in the aperture 60 as the nut 72 is turned tight, two of the faces of the hexagonal flange 70 engage the surfaces 64 of the projections 62. This engagement also prevents the F-connector from turning as the cable ends are turned onto the threaded portions 64 and 66 of the F-connector to form an interconnection.

Figure 10:
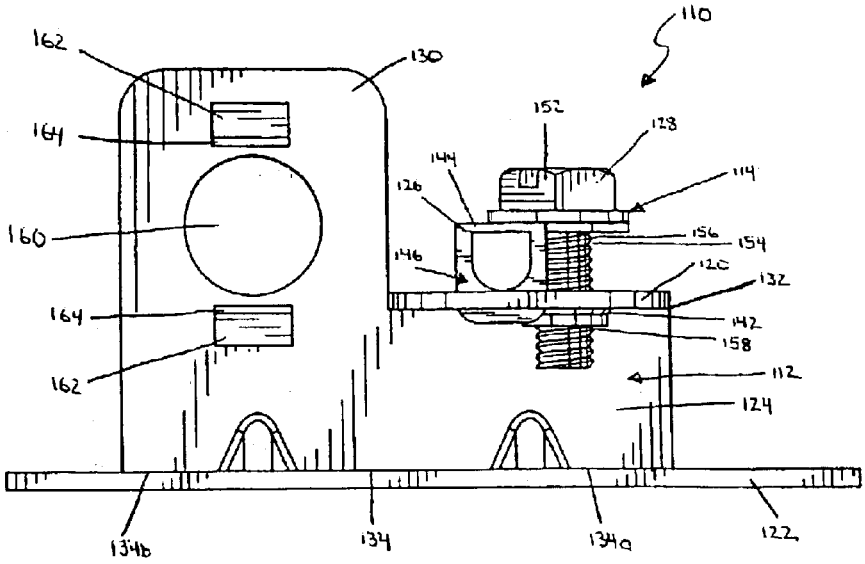
FIG. 10 is an elevation view of an alternate grounding connector embodying features of the present invention.
Figure 11:
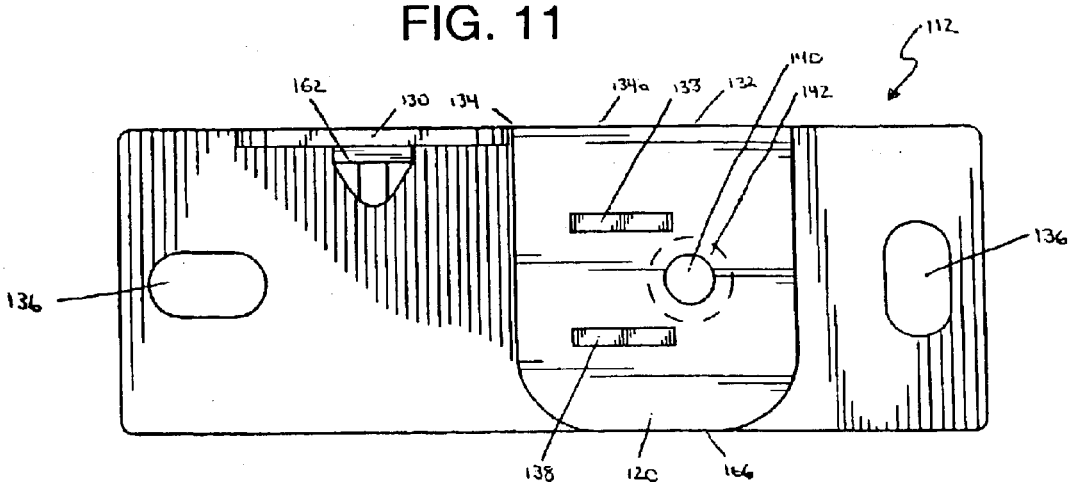
FIG. 11 is a plan view of the base of the grounding connector of FIG. 10.
Figure 12:
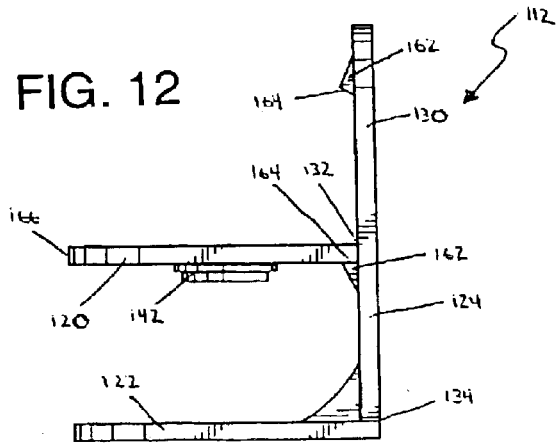
FIG. 12 is a side elevational view of the base of FIG. 11.

Referring to FIGS. 10–12, there is illustrated another embodiment of a grounding connector 110 embodying features of the present invention. The ground connector 110 includes a base 112 to support a ground terminal 114. The ground terminal 114 is designed to receive and secure a grounding wire to form an electrical connection for grounding the connector 110. A grounding wire is attached to a grounding mechanism, such as a grounding rod, grounded utility box, or water pipe. The grounding connector 110 may be made of any suitable conductive material, such that any interconnector attached to the grounding connector 110 is grounded along with the grounding connector 110.

The base 112 includes a support platform 120 and a mounting platform 122 separated by a spacer 124. The spacer 124 interconnects the mounting platform 122 and the support platform 120. The support platform 120 supports and cooperates with the ground terminal 114 to secure a grounding wire. The ground terminal 114 includes a bracket 126 and an actuator 128 to move the bracket 126 between a wire receiving position and a wire securing position. The actuator 128 positions the bracket 126 such that the bracket 126 secures a grounding wire to the grounding connector 110. The clearance between the mounting platform 122 and the support platform 120 is designed to provide room for the ground terminal 114 to operate throughout its entire range of motion between the wire receiving and wire securing positions. A tab 130, which may support an interconnection, is affixed to and supported by the mounting platform 122 of the base 112 as well. The tab 130 is designed to space an interconnection from the base 112 and support platform 120 a sufficient distance in order to facilitate the attachment of cables to an interconnector.

The support platform 120, mounting platform 122, spacer 124, and tab 130 are generally rectangular planar members and all may be formed from an integral piece of suitable material. The support platform 120 extends generally parallel to the mounting platform 122. The spacer 124 extends at an angle of generally ninety (90) degrees to the support platform 120 and mounting platform 122. The spacer 124 also includes an elongated edge 132. The support platform 120 extends along the elongated edge 132 of the spacer 124. The tab 130 is adjacent to the support platform 120 and extends at generally ninety (90) degrees to the support platform 120. The base 112 is made from any suitable electrically conductive material, such as 0.050" stiff temper brass.

The mounting platform 122 defines anchor holes 136 that are used to attach the grounding connector 110 to a wall of a building or any other convenient structure, preferably a generally flat portion of a structure located near both the cable interconnection and the grounding mechanism. The holes 136 may receive any appropriate fastener, such as a screw, bolt, nail, staple, or rivet. The mounting platform 122 is sized and the holes 136 are spaced from the support platform 120 and tab 130 so as to provide sufficient room to allow the convenient use of an appropriate tool with the fastener.

As discussed above, the support platform 120 cooperates with the ground terminal 114 to secure an appropriate ground wire. The support platform 120 defines a pair of elongated guide apertures 138. The guide apertures 138 are spaced from one another and run parallel to one another. Further, the guide apertures 138 are generally rectangular in shape and are set generally parallel to an edge 166 of the support platform 120. This configuration facilitates the insertion of a grounding wire into the ground terminal 114 and the operation of the ground terminal 114. The support platform 120 also defines a circular aperture 140 partially between the guide apertures 138. The aperture 140 may be fitted with a threaded bushing 142 to cooperate with a screw or bolt. The guide apertures 138 and the circular aperture 140 are located generally in the center of the support platform 120. This location spaces the ground terminal 114 a sufficient distance from an interconnection connected to the tab 130 to facilitate the operation of the ground terminal 114.

The ground terminal 114 includes the bracket 126 and the actuator 128. The bracket 126 includes a generally planar bridge 144 with a generally square portion and an arcuate portion. The bracket 126 also includes a pair of guides 146 interconnected by the planar bridge 144 of the bracket 126. The guides 146 extend from opposite edges of the planar bridge 144 and are generally ninety (90) degrees to the planar bridge 144. Each guide 146 defines a U-shaped aperture 148 that is sized sufficiently large and designed to readily receive a ground wire. The U-shaped apertures 148 are aligned so that a ground wire can readily pass through both apertures 148.

The arcuate portion of the planar bridge 144 of the bracket 126 defines a circular aperture through which the actuator 128 extends. The illustrated actuator 128 is in the form of a bolt with a head portion 152 and a threaded shaft portion 154. The head portion 152 may have a hexagonal configuration and a slot for use with different types of tools. Other devices, such as thumbscrews or screws, including sheet metal screws, machine screws, or other types of screws, may be employed as the actuator 128 and different head configurations may also be utilized.

The head portion 152 of the actuator 128 engages one side of the arcuate portion of the bridge 144 about the circular aperture, and the threaded shaft 154 extends through the circular aperture. To maintain the shaft 154 in the circular aperture with the head portion 152 generally against the arcuate portion of the bridge 144, one or more threads 156 adjacent to the other side of the bridge 144 are deformed. With the diameter of the circular aperture slightly larger than the diameter of the threaded shaft portion 154, the actuator 128 is able to rotate freely in the aperture without moving relative to the bridge 144 because of the head portion 152 and the deformed threads 156. Further, the threads 158 near the end of the threaded shaft portion 154 may be deformed as well to prevent removal of the ground terminal 114 from the base 112. As a result, the grounding connector becomes a one-piece captivated connector. The components of the ground terminal 114 may be made from any suitable electrically conductive material, such as 0.045" stiff temper brass.

Alternatively, the head portion 152 of the actuator 128 is cold formed and the remaining shaft portion for the actuator 128 is inserted through the circular aperture of the bracket 126. Threads are then formed on the shaft portion to form the threaded shaft 154. The threading is not done on the shaft portion extending through the aperture and is larger in diameter than the circular aperture. Thus, the threaded shaft 154 is allowed to rotate relatively freely in the aperture, and the threading prohibits the actuator 128 from moving longitudinally relative to the bridge 144.

In another alternative form, as shown in FIG. 7, the bracket 608 includes a generally planar bridge 610 with a generally square portion 610*a* and a forked portion 610*b*. The bracket 608 also includes a pair of guides 612 interconnected by the generally square portion 610*a* of the bracket 608. The guides 612 extend from opposite edges of the square portion 610*a* and are generally ninety (90) degrees to the square portion 610*a*. Each guide 612 defines a U-shaped aperture 614 that is designed sufficiently larger than the desired ground wire to facilitate easy receipt of such wire. The U-shaped apertures 614 are aligned so that the ground wire can readily pass through both.

The forked portion 610*b* of the bracket 608 defines slot with a circular portion 616 and a tapered passage 618. The tapered passage 618 leads to the circular portion 616 and opens opposite the square portion 610*a* of the bridge 610. The intersection of the tapered portion 618 and the circular portion 616 forms a neck 632. The forked portion 610*b*, and the circular portion 616 of the slot locate the actuator 620 so as not to be interfered with by a grounding wire extending through the U-shaped apertures 614.

The illustrated actuator 620 is in the form of a bolt with a head portion 622 and a threaded shaft portion 624. The head portion 622 may include a hexagonal configuration and a slot for use with a variety of tools. The actuator 620 also includes an unthreaded portion 626 located between the head portion 622 and the threaded shaft portion 624. The unthreaded portion 626 has a diameter slightly smaller than the threaded shaft portion 624. Other devices, such as a thumbscrew or screw, including a sheet metal screw or machine screw, may be formed with the unthreaded portion 626 adjacent the head portion 622 and be employed as the actuator 620, as well as other head configurations for use with different tools.

To assemble the ground terminal 114, the unthreaded portion 626 is inserted into the tapered portion 618 and is moved toward the circular portion 616. The edges of the tapered portion 618 guide the movement for installation of the actuator 620 to the neck 632. The unthreaded portion 626 forces the tapered portion 618 to expand outward, which in turn allows the unthreaded portion 626 to snap through the neck 632 into place within the circular portion 616. The unthreaded portion 626 is maintained laterally in the circular portion 616 by the neck 632. The head portion 622 engages one side of the forked portion 610*b* of the bridge 610 about the circular aperture 616 and the unthreaded portion 626 extends through the circular aperture 616 for free rotation. The threaded shaft portion 624 and the head portion 622 of the actuator 620 maintain longitudinally the unthreaded portion 626 in the circular aperture 616. The head portion 622 is generally against a first side 628 of the forked portion 610*b* of the bridge 610 and the threaded shaft portion 624 is generally against a second side 630 of the forked portion 610*b*.

More specifically, with the diameter of the circular portion 616 slightly larger than the diameter of the unthreaded portion 626, the actuator 620 is able to rotate relatively freely in the aperture 616 without moving longitudinally relative to the bridge 610 because of the head portion 622 and the threaded shaft portion 624. Further, threads near the end of the threaded shaft portion 624 may be deformed after connection to the base 112 of the grounding connector 10 to prevent the ground terminal 114 from becoming separated from the base 112. As a result, the grounding connector 110 becomes a one-piece captivated connector. The components of the ground terminal 114 may be made from any suitable electrically conductive material, such as 0.045" stiff temper brass.

In yet another alternative form, as shown in FIGS. 8 and 9, the bracket 710 includes a generally planar bridge 712 with a generally square portion 712*a* and a forked portion 712*b*. The bracket 710 also includes a pair of guides 714 interconnected by the generally square portion 712*a* of the bracket 710. The guides 714 extend from opposite edges of the square portion 712*a* and are generally ninety (90) degrees to the square portion 712*b*. Each guide 714 defines an aperture 716 that is designed sufficiently larger than the desired ground wire to facilitate easy receipt of such wire.

More specifically, the aperture 716 includes a generally U-shaped portion 716*a* located opposite the planar bridge 712 and a generally V-shaped portion 716*b* generally adjacent the planar bridge 712. The U-shaped portion 716*a* and the V-shaped portion 716*b* intersect in generally the middle of the length of the guide 714. The V-shaped portion 716*b* may have a flattened base 718. The flattened base 718 may have various dimensions that maintain the V-shape of the V-shaped portion 716*b* but, preferably, has dimensions smaller than the diameter of a 14 gauge wire.

The V-shaped portion 716*b* of the aperture 716 is designed with dimensions such that the aperture 716 contacts the ground wire on each side of the ground wire. As such, the ground wire cannot move or pivot relative to the aperture 716 and the edges of the aperture 716 hold the ground wire under high pressure on both sides of the ground wire. The apertures 716 are aligned so that the ground wire can readily pass through both. Although in the present alternative form, the aperture 716 includes a generally U-shaped portion 716*a* and a generally V-shaped portion 716*b*, any shape that increases the pressure on the ground wire and discourages movement or pivoting of the ground wire while allowing the ground wire to be inserted with ease may be used.

In addition, the bracket may be formed with any additional structural features anywhere thereon that applies an increased pressure on the grounding wire. For example, the square portion 712*a* may have a portion that extends into the area between the guides 714. That is, the square portion 712*a* could be stamped to push a portion into the area between the guides 714. This portion engages the grounding wire to provide increased binding pressure on the wire.

The forked portion 712*b* of the bracket defines a slot with a circular portion 720 and a tapered passage 722. The tapered passage 722 leads to the circular portion 720 and opens opposite the square portion 712*a* of the bridge 712. The intersection of the tapered passage 722 and the circular portion 720 forms a neck 724. The forked portion 712*b* and the circular portion 720 of the slot locate the actuator 620, as discussed above, so as not to be interfered with by a grounding wire extending through the aperture 716.

To assemble the ground terminal 114, the unthreaded portion 626 of the actuator 620 is inserted into the tapered passage 722 and is moved toward the circular portion 720. The edges of the tapered passage 722 guide the movement of the actuator 620 to the neck 724. The unthreaded portion 626 forces the tapered passage 722 to expand outward, which in turn allows the unthreaded portion 626 to snap through the neck 724 into place within the circular portion 720. The unthreaded portion 626 is maintained laterally in the circular portion 720 by the neck 724. The head portion 622 of the actuator 620 engages one side of the forked portion 712*b* of the bridge 712 about the circular aperture 616 and the unthreaded portion 626 extends though the circular aperture 616 for free rotation. The threaded shaft portion 624 and the head portion 622 of the actuator 620 maintain longitudinally the unthreaded portion 626 in the circular aperture 616. The head portion 622 is generally against a first side 726 of the forked portion 712*b* of the bridge 712 and the threaded shaft portion 624 is generally against a second side 728 of the forked portion 712*b*.

More specifically, with the diameter of the circular portion 720 slightly larger than the diameter of the unthreaded portion 626, the actuator 620 is able to rotate relatively freely in the circular aperture 616 without moving longitudinally relative to the bridge 712 because of the head portion 622 and the threaded shaft portion 624. Further, threads near the end of the threaded shaft portion 624 may be deformed after connection to the base 112 of the grounding connector 10 to prevent the ground terminal 114 from becoming separated from the base 112. As a result, the grounding connector 110 becomes a one-piece captivated connector. The components of the ground terminal 114 may be made from any suitable electrically conductive material, such as 0.045" stiff temper brass.

The guides 146 of the bracket 126 are received in the guide apertures 138 of the support platform 120 of the base 112. The clearance between the guides 146 and the guide apertures 138 is preferably only that needed to facilitate smooth movement of the guides 146 relative to the support platform 120. The actuator 128 threads into the threaded bushing 142 mounted in the aperture 140 of the support platform 120. The actuator 128 extends only slightly beyond the guides 146 to accommodate the thickness of the bushing 142 and to allow most, if not all, of the U-shaped apertures 148 to be exposed to aid in the insertion of a ground wire without releasing the actuator 128 from the bushing 142.

However, the actuator 128 should not extend too far beyond the guides 146 in order to avoid undesired contact between the actuator 128 and the mounting platform 122. More specifically, the length of the spacer 124 of the base 112 is coordinated with the length of the actuator 128 and the guides 146 so as to provide sufficient clearance between the support platform 120 and the mounting platform 122 to allow the actuator 128 to operate efficiently. That is, for example, the actuator 128 is turned counter-clockwise to move the bridge 144 of the bracket 126 away from the support platform 120 to expose the U-shaped apertures 148 for receiving a grounding wire and is turned clockwise to move the bridge 144 of the bracket 126 toward the support platform 120 to secure a grounding wire between the bridge 144 and support platform 120. The spacer 124 should be long enough to allow the actuator 128 to both move between the wire receiving position and the wire engaging position without contacting the mounting platform 122. Contact with the mounting platform 122 could cause damage to the grounding connector 110 or could cause the connection of a grounding wire to the grounding connector 110 to be compromised. Additionally, it is preferable to minimize the overall height of the ground terminal 114 so as to produce a "low-profile" grounding connector 110 which minimizes the potential for breakage of the ground terminal 114 when struck by an object after installation.

As mentioned above, the base 112 supports the tab 130, which, in turn, supports an interconnection. As shown in FIGS. 10 and 12, the tab 130 also includes a pair of projections 162 with surfaces 164 for engaging an interconnector. These projections 162 assist in the installation of an interconnector into the tab 130 and in the attachment of cables to be interconnected at the grounding connector 110.

For example, an interconnector may be an "F" series connector commonly used to interconnect coaxial cables. An F-connector commonly includes two back-to-back threaded shaft portions with female ends to cooperate with common connectors fixed on the ends of coaxial cables. The threaded shaft portions are separated by a hexagonal flange. One of the threaded shaft portions extends through the aperture 160 of the tab 130 and is secured within the aperture with a nut. To prevent the F-connector from rotating in the aperture 160 while the nut is tightened, the surfaces 164 on the projections 162 engage two surfaces of the hexagonal flange. This engagement also prevents the F-connector from turning as cables to be interconnected are turned onto the threaded portions of the F-connector to form an interconnection.

Figure 13:
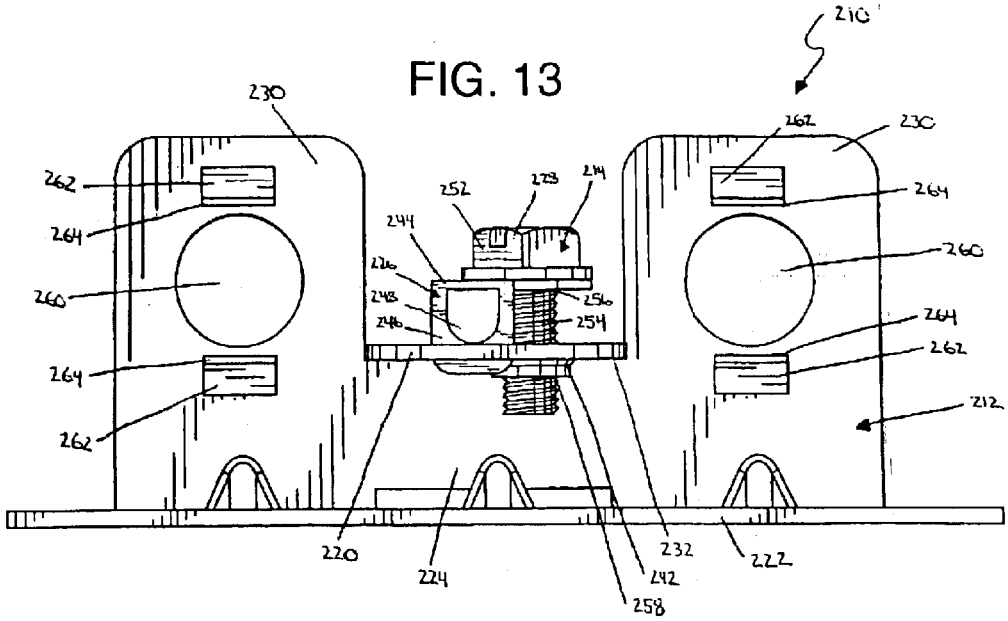
FIG. 13 is an elevation view of another alternate grounding connector embodying features of the present invention.
Figure 14:
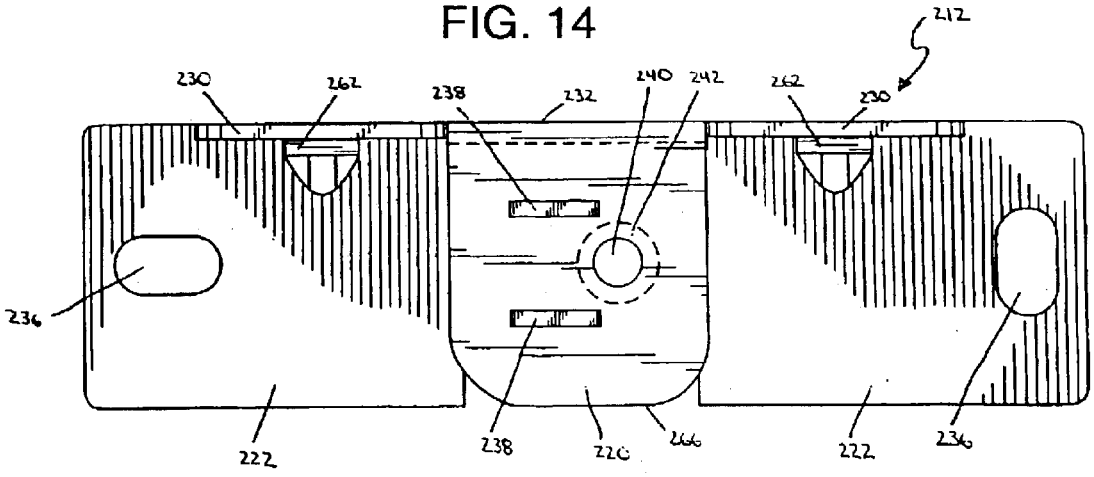
FIG. 14 is a plan view of the base of the grounding connector of FIG. 13.
Figure 15:
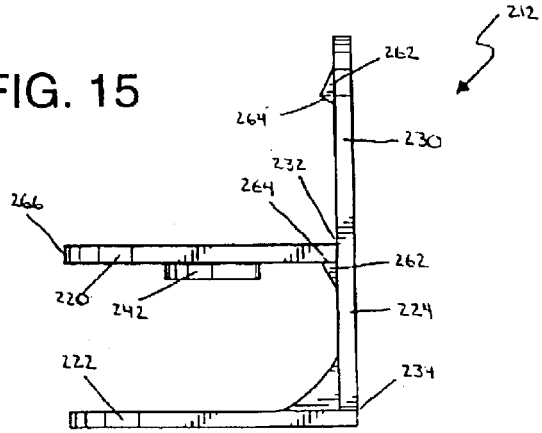
FIG. 15 is a side elevational view of the base of FIG. 14.

Referring to FIGS. 13–15, there is depicted another embodiment of a grounding connector 210 embodying features of the present invention. The ground connector 210 includes a base 212 that supports a ground terminal 214. The ground terminal 214 is designed to receive and secure a grounding wire in order to form an electrical connection between the grounding wire and the connector 210, such that any interconnector attached to the grounding connector 210 is grounded along with the grounding connector 210. The opposite end of a grounding wire is attached to a grounding mechanism, such as a grounding rod, grounded utility box, or water pipe. The grounding connector 210 may be made of any suitable conductive material.

The base 212 includes a support platform 220 and a mounting platform 222 separated by a spacer 224. The spacer 224 interconnects the mounting platform 222 and the support platform 220. The support platform 220 supports and cooperates with the ground terminal 214 to secure a grounding wire to the connector 210. The ground terminal 214 includes a bracket 226 and an actuator 228 to move the bracket 226 between a wire receiving position and a wire securing position. The actuator 228 positions the bracket 226 such that the bracket 226 may secure a grounding wire to the grounding connector 210. The clearance between the mounting platform 222 and the support platform 220 is designed to provide room for the ground terminal 214 to shift between the wire receiving and wire securing positions. The base 212 also supports a pair of tabs 230 which, in turn, may support a pair of interconnections. The tabs 230 are designed to space interconnections a sufficient distance from the base 212 and support platform 220 in order to facilitate the attachment of cables to the interconnections.

The support platform 220, mounting platform 222, spacer 224, and tab 230 are generally rectangular planar members and may be formed from a single piece of integral material. The support platform 220 extends generally parallel to the mounting platform 222 and is generally centered above the mounting platform 222. The spacer 224 forms an angle of generally ninety (90) degrees with the support platform 220 and mounting platform 222. The spacer 224 also includes an elongated edge 232 at the transition between the support platform 220 and the spacer 224. The tabs 230 are adjacent the ends of the elongated edge 232. The tabs 230 extend at generally ninety (90) degrees to the mounting platform 222. The base 212 is made from any suitable electrically conductive material, such as 0.050" stiff temper brass.

The mounting platform 222 defines anchor holes 236 that are used to attach the grounding connector 210 to a wall of a building or any other convenient structure. The holes 236 may receive any appropriate fastener, such as a screw, bolt, nail, staple, or rivet. The mounting platform 222 is sized and the holes 236 are located in relation to the support platform 220 and tabs 230 such that sufficient room is provided to allow convenient use of an appropriate tool with the fastener.

As discussed above, the support platform 220 cooperates with the ground terminal 214 to secure a ground wire to the grounding connector 210. The support platform 220 defines a pair of elongated guide apertures 238. The guide apertures 238 are spaced from one another and run parallel to one another. Further, the guide apertures 238 are generally rectangular in shape and are set generally parallel to an edge 266 of the support platform 220. This orientation aids in the insertion of a grounding wire into the ground terminal 214. The support platform 220 also defines a circular aperture 240 partially between the guide apertures 238. The aperture 240 may be threaded or may be fitted with a threaded bushing 242 to cooperate with a screw or bolt. The guide apertures 238 and the circular aperture 240 are generally centered on the support platform 220. This location spaces the ground terminal 214 from the tabs 230 a sufficient distance to allow easy access to the ground terminal 214.

The ground terminal 214 includes the bracket 226 and the actuator 228. The bracket 226 includes a generally planar bridge 244 with an arcuate portion and a generally square portion. The bracket 226 also includes a pair of guides 246. The guides 246 extend from opposite edges of the planar bridge 244 and are generally ninety (90) degrees to the planar bridge 244. Each guide 246 defines a U-shaped aperture 248 that is sized sufficiently large and otherwise designed to readily and easily receive a ground wire. The U-shaped apertures 248 are aligned such that a ground wire may readily pass through both apertures 248 during installation.

The arcuate portion of the planar bridge 244 of the bracket 226 defines a circular aperture through which the actuator 228 extends. The actuator 228 is illustrated in the form of a bolt with a head portion 252 and a threaded shaft portion 254. The head portion 252 also has a hexagonal configuration and a slot for use with different types of tools and a threaded shaft portion 254. Other devices, such as thumbscrews or screws, including sheet metal and machine screws, may be put to use as the actuator 228 in place of the bolt. Different head configurations may also be used for the head portion.

The head portion 252 engages one side of the bridge 244 about the circular aperture, and the threaded shaft 254 extends through the circular aperture. To retain the shaft 254 in the circular aperture, one or more threads 256 adjacent to the other side of the bridge 244 may be deformed. The diameter of the circular aperture is slightly larger than the diameter of the threaded shaft portion 254, such that the actuator 228 is able to rotate freely within the aperture without moving relative to the bridge 244 because it is held between the head portion 252 and the deformed threads 256. Further, threads 258 near the end of the threaded shaft portion 254 may be deformed as well to prevent the removal of the ground terminal 214 from the base 212. As a result, the grounding connector 210 becomes a one-piece captivated connector. The components of the ground terminal 214 may be made from any suitable electrically conductive material, such as 0.045" stiff temper brass.

Alternatively, the head portion 252 of the actuator 228 is cold formed and the remaining shaft portion for the actuator 228 is inserted through the circular aperture of the bracket 226. Threads are then formed on the shaft portion to form the threaded shaft 254. The threading is not done on the shaft portion extending through the aperture and is larger in diameter than the circular aperture. Thus, the threaded shaft 254 is allowed to rotate relatively freely in the aperture, and the threading prohibits the actuator 228 from moving longitudinally relative to the bridge 244.

In another alternative form, as shown in FIG. 7, the bracket 608 includes a generally planar bridge 610 with a generally square portion 610*a* and a forked portion 610*b*. The bracket 608 also includes a pair of guides 612 interconnected by the generally square portion 610*a* of the bracket 608. The guides 612 extend from opposite edges of the square portion 610*a* and are generally ninety (90) degrees to the square portion 610*a*. Each guide 612 defines a U-shaped aperture 614 that is designed sufficiently larger than the desired ground wire to facilitate easy receipt of such wire. The U-shaped apertures 614 are aligned so that the ground wire can readily pass through both.

The forked portion 610*b* of the bracket 608 defines slot with a circular portion 616 and a tapered passage 618. The tapered passage 618 leads to the circular portion 616 and opens opposite the square portion 610*a* of the bridge 610. The intersection of the tapered portion 618 and the circular portion 616 forms a neck 632. The forked portion 610*b*, and the circular portion 616 of the slot locate the actuator 620 so as not to be interfered with by a grounding wire extending through the U-shaped apertures 614.

The illustrated actuator 620 is in the form of a bolt with a head portion 622 and a threaded shaft portion 624. The head portion 622 may include a hexagonal configuration and a slot for use with a variety of tools. The actuator 620 also includes an unthreaded portion 626 located between the head portion 622 and the threaded shaft portion 624. The unthreaded portion 626 has a diameter slightly smaller than the threaded shaft portion 624. Other devices, such as a thumbscrew or screw, including a sheet metal screw or machine screw, may be formed with the unthreaded portion 626 adjacent the head portion 622 and be employed as the actuator 620, as well as other head configurations for use with different tools.

To assemble the ground terminal 214, the unthreaded portion 626 is inserted into the tapered portion 618 and is moved toward the circular portion 616. The edges of the tapered portion 618 guide the movement for installation of the actuator 620 to the neck 632. The unthreaded portion 626 forces the tapered portion 618 to expand outward, which in turn allows the unthreaded portion 626 to snap through the neck 632 into place within the circular portion 616. The unthreaded portion 626 is maintained laterally in the circular portion 616 by the neck 632. The head portion 622 engages one side of the forked portion 610*b* of the bridge 610 about the circular aperture 616 and the unthreaded portion 626 extends through the circular aperture 616 for free rotation. The threaded shaft portion 624 and the head portion 622 of the actuator 620 maintain longitudinally the unthreaded portion 626 in the circular aperture 616. The head portion 622 is generally against a first side 628 of the forked portion 610*b* of the bridge 610 and the threaded shaft portion 624 is generally against a second side 630 of the forked portion 610*b*.

More specifically, with the diameter of the circular portion 616 slightly larger than the diameter of the unthreaded portion 626, the actuator 620 is able to rotate relatively freely in the aperture 616 without moving longitudinally relative to the bridge 610 because of the head portion 622 and the threaded shaft portion 624. Further, threads near the end of the threaded shaft portion 624 may be deformed after connection to the base 212 of the grounding connector 210 to prevent the ground terminal 214 from becoming separated from the base 212. As a result, the grounding connector 210 becomes a one-piece captivated connector. The components of the ground terminal 214 may be made from any suitable electrically conductive material, such as 0.045" stiff temper brass.

In yet another alternative form, as shown in FIGS. 8 and 9, the bracket 710 includes a generally planar bridge 712 with a generally square portion 712*a* and a forked portion 712*b*. The bracket 710 also includes a pair of guides 714 interconnected by the generally square portion 712*a* of the bracket 710. The guides 714 extend from opposite edges of the square portion 712*a* and are generally ninety (90) degrees to the square portion 712*b*. Each guide 714 defines an aperture 716 that is designed sufficiently larger than the desired ground wire to facilitate easy receipt of such wire.

More specifically, the aperture 716 includes a generally U-shaped portion 716*a* located opposite the planar bridge 712 and a generally V-shaped portion 716*b* generally adjacent the planar bridge 712. The U-shaped portion 716*a* and the V-shaped portion 716*b* intersect in generally the middle of the length of the guide 714. The V-shaped portion 716*b* may have a flattened base 718. The flattened base 718 may have various dimensions that maintain the V-shape of the V-shaped portion 716*b* but, preferably, has dimensions smaller than the diameter of a 14 gauge wire.

The V-shaped portion 716*b* of the aperture 716 is designed with dimensions such that the aperture 716 contacts the ground wire on each side of the ground wire. As such, the ground wire cannot move or pivot relative to the aperture 716 and the edges of the aperture 716 hold the ground wire under high pressure on both sides of the ground wire. The apertures 716 are aligned so that the ground wire can readily pass through both. Although in the present alternative form, the aperture 716 includes a generally U-shaped portion 716*a* and a generally V-shaped portion 716*b*, any shape that increases the pressure on the ground wire and discourages movement or pivoting of the ground wire while allowing the ground wire to be inserted with ease may be used.

In addition, the bracket may be formed with any additional structural features anywhere thereon that applies an increased pressure on the grounding wire. For example, the square portion 712*a* may have a portion that extends into the area between the guides 714. That is, the square portion 712*a* could be stamped to push a portion into the area between the guides 714. This portion engages the grounding wire to provide increased binding pressure on the wire.

The forked portion 712*b* of the bracket defines a slot with a circular portion 720 and a tapered passage 722. The tapered passage 722 leads to the circular portion 720 and opens opposite the square portion 712*a* of the bridge 712. The intersection of the tapered passage 722 and the circular portion 720 forms a neck 724. The forked portion 712*b* and the circular portion 720 of the slot locate the actuator 620, as discussed above, so as not to be interfered with by a grounding wire extending through the aperture 716.

To assemble the ground terminal 214, the unthreaded portion 626 of the actuator 620 is inserted into the tapered passage 722 and is moved toward the circular portion 720. The edges of the tapered passage 722 guide the movement of the actuator 620 to the neck 724. The unthreaded portion 626 forces the tapered passage 722 to expand outward, which in turn allows the unthreaded portion 626 to snap through the neck 724 into place within the circular portion 720. The unthreaded portion 626 is maintained laterally in the circular portion 720 by the neck 724. The head portion 622 of the actuator 620 engages one side of the forked portion 712*b* of the bridge 712 about the circular aperture 616 and the unthreaded portion 626 extends though the circular aperture 616 for free rotation. The threaded shaft portion 624 and the head portion 622 of the actuator 620 maintain longitudinally the unthreaded portion 626 in the circular aperture 616. The head portion 622 is generally against a first side 726 of the forked portion 712*b* of the bridge 712 and the threaded shaft portion 624 is generally against a second side 728 of the forked portion 712*b*.

More specifically, with the diameter of the circular portion 720 slightly larger than the diameter of the unthreaded portion 626, the actuator 620 is able to rotate relatively freely in the circular aperture 616 without moving longitudinally relative to the bridge 712 because of the head portion 622 and the threaded shaft portion 624. Further, threads near the end of the threaded shaft portion 624 may be deformed after connection to the base 212 of the grounding connector 210 to prevent the ground terminal 214 from becoming separated from the base 212. As a result, the grounding connector 210 becomes a one-piece captivated connector. The components of the ground terminal 214 may be made from any suitable electrically conductive material, such as 0.045" stiff temper brass.

The guides 246 of the bracket 226 are received in the guide apertures 238 of the support platform 220. The clearance between the guides 246 and the guide apertures 238 is preferably only that needed to allow smooth movement of the guides 246 relative to the support platform 220. The actuator 228 threads into the threaded bushing 242 mounted in the aperture 240 of the support platform 220. The actuator 228 extends only slightly beyond the guides 246 to allow most, if not all, of the U-shaped apertures 248 to be exposed in order to aid in the insertion of a ground wire into the bracket 226 without releasing the actuator 228 from the bushing 242.

However, the actuator 228 should not extend too far beyond the end of the guides 246 in order to prevent undesired contact between the actuator 228 and the mounting platform 222. More specifically, the length of the spacer 224 of the base 212 is coordinated with the length of the actuator 228 and the guides 246 such that sufficient clearance between the support platform 220 and the mounting platform 222 is provided in order to allow the actuator 228 to move throughout its full range. That is, for example, the actuator 228 is turned counter-clockwise to move the bracket 226 away from the support platform 220 to expose the U-shaped apertures 248 for receiving a grounding wire and is turned clockwise to move the bridge 244 of the bracket 226 toward the support platform 220 to secure, in a clamping manner, a grounding wire between the bridge 244 and support platform 220. The spacer 224 should be long enough to allow the actuator 228 to fully move between the wire receiving position and the wire engaging position without contacting the mounting platform 222. Contact with the mounting platform 222 could cause damage to the grounding connector 210 or could cause the connection of a grounding wire to the grounding connector 210 to be compromised. Additionally, it is preferable to minimize the overall height of the ground terminal 214 so as to produce a "low-profile" grounding connector 210 which minimizes the potential for breakage of the ground terminal 214 when struck by an object after installation.

As mentioned above, the base 212 supports the tabs 230, which, in turn, may support interconnections. Each tab 230 includes a pair of projections 262 with surfaces 264 for engaging an interconnector. These projections 262 prevent undesired rotation of the interconnector to assist in the installation of an interconnector into each of the tabs 230 and in the attachment of cables to an interconnector.

For example, an interconnector may be an "F" series connector commonly used to interconnect coaxial cables. An F-connector commonly includes two back-to-back threaded shaft portions with female ends to cooperate with common connectors fixed on the ends of coaxial cables. The threaded shaft portions are separated by a hexagonal flange. One of the threaded shaft portions extends through the aperture 260 of one of the tabs 230 and is secured within the aperture with a nut. To prevent the F-connector from rotating in the aperture 260 while the nut is tightened, the surfaces 264 on the projections 262 engage two surfaces of the hexagonal flange. This engagement also prevents the F-connector from turning as cables are turned onto the threaded portions of the F-connector to form an interconnection.

The interconnectors attached to the tabs 230 may be for different services, such as telecommunications, cable television, and satellite communications, entering the same building or may be a plurality of the same type of interconnector entering a multi-unit structure. In either case, the grounding connector 210 may be used to ground two interconnections using the same grounding wire.

Figure 16:
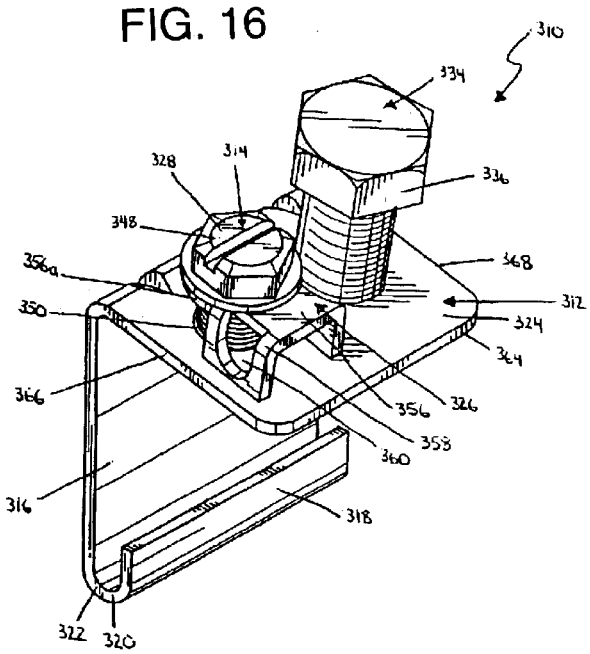
FIG. 16 is a perspective view of another alternate grounding connector embodying features of the present invention.
Figure 17:
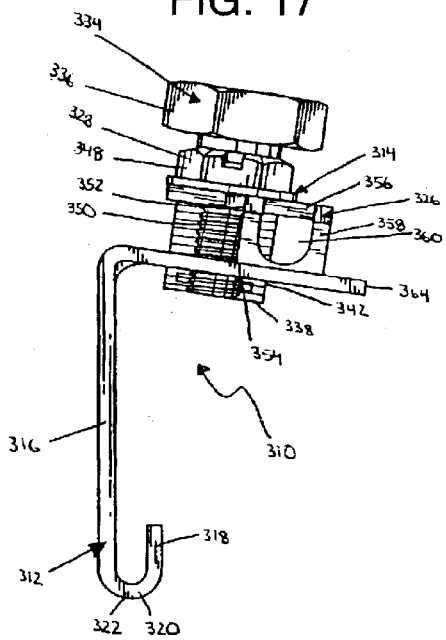
FIG. 17 is a side elevational view of the grounding connector of FIG. 16.
Figure 18:
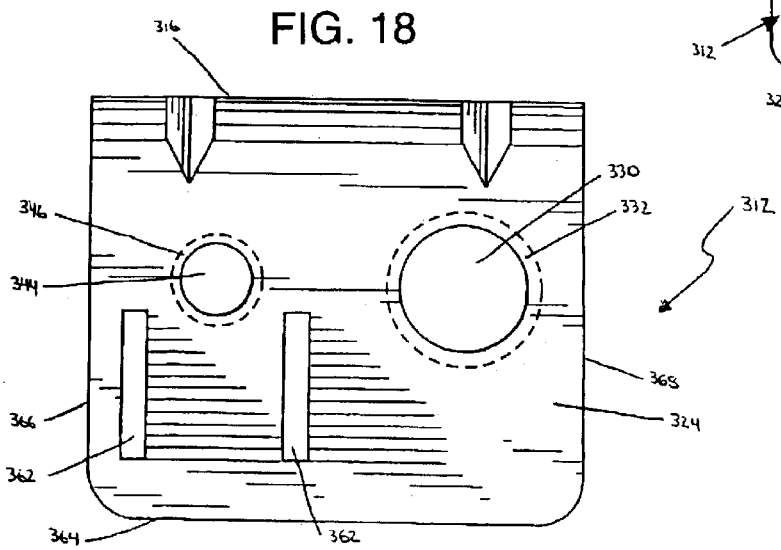
FIG. 18 is a plan view of the base of the grounding connector of FIG. 16.

Referring to FIGS. 16–18, there is illustrated an alternate grounding connector 310 embodying features of the present invention. The grounding connector 310 includes a base 312 to support a ground terminal 314. The ground terminal 314 is designed to receive and secure a grounding wire to the grounding connector 310 and to form an electrical connection between the grounding connector 310 and a grounding wire. The opposite end of a grounding wire is attached to a second grounding connector, such as one of those described supra, that provides an interconnector. The grounding connector 310 may be made of any suitable conductive material, and thus, the grounding wire is grounded along with the grounding connector 310. The grounding connector 310 is designed to be mechanically and electrically attached to the surface of a grounded object, such as a grounded utility box.

The base 312 of the grounding connector 310 includes a front planar portion 316 and a top planar portion 324. The planar portions 316 and 324 are disposed relative to one another at a predetermined angle, such as between generally ninety (90) and forty-five (45) degrees. The edge portion of the front planar portion 316 opposite the top planar portion 324 forms a hook 322. The hook 322 includes a curved base portion 320 and a rear straight portion 318. The straight portion 318 is substantially parallel to the front planar portion 316 and is also substantially shorter in length than the front planar portion 316. The base 312 may be made from any suitable conductive material, such as 0.048" stainless steel.

The top portion 324 defines two apertures 330 and 344 that extend axially through the top planar portion 324 and are located opposite the hook 322. The opening 330 is located generally adjacent the front planar portion 316, such that it extends generally over the hook 322 of the front planar portion 316 and does not interfere with the attachment of a grounding wire.

The top portion 324 preferably forms an angle of less than ninety (90) degrees with the front planar portion 316. When pressure is applied, through the rotation of a fastener 334 after it contacts the surface to which the connector 310 is being attached, the top portion 324 will deflect upward and bring it to a position substantially perpendicular to the front planar portion 316. This biasing effect aids in mechanically attaching the grounding connector 310 to the surface to which the connector 310 is attached. Although a spring-like flexibility and resiliency between the front portion 316 and the top portion 324 is preferred, the top portion 324 may also be fixed relative to the front portion 316 by strengthening the design and/or constructing the connector 310 of materials having greater rigidity. It is preferred that the front planar portion 316 and hook 322 should remain rigid. Therefore, the construction of these members 316, 318, and 320 is preferably of rigid metal.

The top portion 324 cooperates with the ground terminal 314 to attach an appropriate ground wire to the connector 310. The top portion 324 defines a pair of elongated guide apertures 362. The guide apertures 362 are spaced from one another and run parallel to each other. Further, the guide apertures 362 are generally rectangular in shape and are set perpendicular to the rear edge 364 of the top planar portion 324. This configuration facilitates the association of a grounding wire with the ground terminal 314 and the operation of the ground terminal 314. The top portion 324 also defines a circular aperture 344 partially between the guide apertures 362. The aperture 344 may be fitted with a threaded bushing 346 to cooperate with the actuator 328. The guide apertures 362 and the circular aperture 344 are located generally toward the corner formed by the rear edge 364 and a first side edge 366 of the top portion 324. This location spaces the ground terminal 314 from the securing fastener 334 a sufficient distance to facilitate the effective and efficient operation of the ground terminal 314, as well as the fastener 334. The top portion 324 also defines a second circular aperture 330. The aperture 330 may be fitted with a threaded bushing 332 to cooperate with the fastener 334. The second circular aperture 330 is located generally along the centerline of the top planar portion 324 near a second side edge 368 of the top portion 324, which is opposite the first side edge 366 of the top planar portion 324. This location spaces the fastener 334 a sufficient distance from the ground terminal 314 to allow the ground terminal 314 and the fastener 334 to operate efficiently and effectively.

As mentioned above, the top portion 324 supports and cooperates with the ground terminal 314 to secure a grounding wire. The ground terminal 314 includes a bracket 326 and an actuator 328 to move the bracket 326 between a wire receiving position and a wire engaging position. That is, the actuator 328 positions the bracket 326 so that the bracket 326 secures a grounding wire to the grounding connector 310. The grounding connector 310 is designed to provide clearance for the ground terminal 314 to operate effectively when shifting between the wire receiving and wire engaging positions.

As previously mentioned, the ground terminal 314 includes the bracket 326 and the actuator 328. With reference to FIGS. 16 and 17, the bracket 326 includes a generally planar bridge 356 with a generally square portion and an arcuate portion. The bracket 326 also includes a pair of guides 358 interconnected by the planar bridge 356 of the bracket 326. The guides 358 extend from opposite edges of the planar bridge 356 and form an angle of about ninety (90) degrees to the planar bridge 356. Each guide 358 defines a U-shaped aperture 360 that is sized sufficiently large enough and is designed to readily receive a ground wire. The U-shaped apertures 360 are aligned so that a ground wire can readily pass through both apertures 360.

The arcuate portion 356*a* of the planar bridge 356 of the bracket 326 defines a circular aperture through which the actuator 328 extends. The illustrated actuator 328 is in the form of a bolt with a head portion 348 and a threaded shaft portion 350. The head portion 348 has a hexagonal configuration with a slot for use with different types of tools. A different type of device, such as a thumbscrew or screw, including a sheet metal screw or machine screw, may be employed as the actuator 328 and different head configurations may also be used.

The head portion 348 engages one side of the arcuate portion 356*a* of the planar bridge 356 about the circular aperture, and the threaded shaft 350 extends through the circular aperture. To maintain the shaft portion 350 in the circular aperture with the head portion 348 generally against the arcuate portion of the bridge 356, one or more threads 352 adjacent to the other side of the bridge 356 may be deformed. The diameter of the circular aperture is slightly larger than the diameter of the threaded shaft portion 350, such that the actuator 328 is able to rotate freely within the aperture without moving relative to the bridge 356 because it is held in place by the head portion 348 and the deformed threads 352. Further, threads 354 near the end of the threaded shaft portion 350 may be deformed as well to prevent the removal of the ground terminal 314 from the base 312. As a result, the grounding connector 310 becomes a one-piece captivated connector. The components of the ground terminal 314 may be made from any suitable electrically conductive material, such as 0.045" stiff temper brass.

Alternatively, the head portion 348 of the actuator 328 is cold formed and the remaining shaft portion for the actuator 328 is inserted through the circular aperture of the bracket 326. Threads are then formed on the shaft portion to form the threaded shaft 350. The threading is not done on the shaft portion extending through the aperture and is larger in diameter than the circular aperture. Thus, the threaded shaft 350 is allowed to rotate relatively freely in the aperture, and the threading prohibits the actuator 328 from moving longitudinally relative to the bridge 356.

In another alternative form, as shown in FIG. 7, the bracket 608 includes a generally planar bridge 610 with a generally square portion 610*a* and a forked portion 610*b*. The bracket 608 also includes a pair of guides 612 interconnected by the generally square portion 610*a* of the bracket 608. The guides 612 extend from opposite edges of the square portion 610*a* and are generally ninety (90) degrees to the square portion 610*a*. Each guide 612 defines a U-shaped aperture 614 that is designed sufficiently larger than the desired ground wire to facilitate easy receipt of such wire. The U-shaped apertures 614 are aligned so that the ground wire can readily pass through both.

The forked portion 610*b* of the bracket 608 defines slot with a circular portion 616 and a tapered passage 618. The tapered passage 618 leads to the circular portion 616 and opens opposite the square portion 610*a* of the bridge 610. The intersection of the tapered portion 618 and the circular portion 616 forms a neck 632. The forked portion 610*b*, and the circular portion 616 of the slot locate the actuator 620 so as not to be interfered with by a grounding wire extending through the U-shaped apertures 614.

The illustrated actuator 620 is in the form of a bolt with a head portion 622 and a threaded shaft portion 624. The head portion 622 may include a hexagonal configuration and a slot for use with a variety of tools. The actuator 620 also includes an unthreaded portion 626 located between the head portion 622 and the threaded shaft portion 624. The unthreaded portion 626 has a diameter slightly smaller than the threaded shaft portion 624. Other devices, such as a thumbscrew or screw, including a sheet metal screw or machine screw, may be formed with the unthreaded portion 626 adjacent the head portion 622 and be employed as the actuator 620, as well as other head configurations for use with different tools.

To assemble the ground terminal 314, the unthreaded portion 626 is inserted into the tapered portion 618 and is moved toward the circular portion 616. The edges of the tapered portion 618 guide the movement for installation of the actuator 620 to the neck 632. The unthreaded portion 626 forces the tapered portion 618 to expand outward, which in turn allows the unthreaded portion 626 to snap through the neck 632 into place within the circular portion 616. The unthreaded portion 626 is maintained laterally in the circular portion 616 by the neck 632. The head portion 622 engages one side of the forked portion 610*b* of the bridge 610 about the circular aperture 616 and the unthreaded portion 626 extends through the circular aperture 616 for free rotation. The threaded shaft portion 624 and the head portion 622 of the actuator 620 maintain longitudinally the unthreaded portion 626 in the circular aperture 616. The head portion 622 is generally against a first side 628 of the forked portion 610*b* of the bridge 610 and the threaded shaft portion 624 is generally against a second side 630 of the forked portion 610*b*.

More specifically, with the diameter of the circular portion 616 slightly larger than the diameter of the unthreaded portion 626, the actuator 620 is able to rotate relatively freely in the aperture 616 without moving longitudinally relative to the bridge 610 because of the head portion 622 and the threaded shaft portion 624. Further, threads near the end of the threaded shaft portion 624 may be deformed after connection to the base 312 of the grounding connector 310 to prevent the ground terminal 314 from becoming separated from the base 312. As a result, the grounding connector 310 becomes a one-piece captivated connector. The components of the ground terminal 314 may be made from any suitable electrically conductive material, such as 0.045" stiff temper brass.

In yet another alternative form, as shown in FIGS. 8 and 9, the bracket 710 includes a generally planar bridge 712 with a generally square portion 712*a* and a forked portion 712*b*. The bracket 710 also includes a pair of guides 714 interconnected by the generally square portion 712*a* of the bracket 710. The guides 714 extend from opposite edges of the square portion 712*a* and are generally ninety (90) degrees to the square portion 712*b*. Each guide 714 defines an aperture 716 that is designed sufficiently larger than the desired ground wire to facilitate easy receipt of such wire.

More specifically, the aperture 716 includes a generally U-shaped portion 716*a* located opposite the planar bridge 712 and a generally V-shaped portion 716*b* generally adjacent the planar bridge 712. The U-shaped portion 716*a* and the V-shaped portion 716*b* intersect in generally the middle of the length of the guide 714. The V-shaped portion 716*b* may have a flattened base 718. The flattened base 718 may have various dimensions that maintain the V-shape of the V-shaped portion 716*b* but, preferably, has dimensions smaller than the diameter of a 14 gauge wire.

The V-shaped portion 716*b* of the aperture 716 is designed with dimensions such that the aperture 716 contacts the ground wire on each side of the ground wire. As such, the ground wire cannot move or pivot relative to the aperture 716 and the edges of the aperture 716 hold the ground wire under high pressure on both sides of the ground wire. The apertures 716 are aligned so that the ground wire can readily pass through both. Although in the present alternative form, the aperture 716 includes a generally U-shaped portion 716*a* and a generally V-shaped portion 716*b*, any shape that increases the pressure on the ground wire and discourages movement or pivoting of the ground wire while allowing the ground wire to be inserted with ease may be used.

In addition, the bracket may be formed with any additional structural features anywhere thereon that applies an increased pressure on the grounding wire. For example, the square portion 712*a* may have a portion that extends into the area between the guides 714. That is, the square portion 712*a* could be stamped to push a portion into the area between the guides 714. This portion engages the grounding wire to provide increased binding pressure on the wire.

The forked portion 712*b* of the bracket defines a slot with a circular portion 720 and a tapered passage 722. The tapered passage 722 leads to the circular portion 720 and opens opposite the square portion 712*a* of the bridge 712. The intersection of the tapered passage 722 and the circular portion 720 forms a neck 724. The forked portion 712*b* and the circular portion 720 of the slot locate the actuator 620, as discussed above, so as not to be interfered with by a grounding wire extending through the aperture 716.

To assemble the ground terminal 314, the unthreaded portion 626 of the actuator 620 is inserted into the tapered passage 722 and is moved toward the circular portion 720. The edges of the tapered passage 722 guide the movement of the actuator 620 to the neck 724. The unthreaded portion 626 forces the tapered passage 722 to expand outward, which in turn allows the unthreaded portion 626 to snap through the neck 724 into place within the circular portion 720. The unthreaded portion 626 is maintained laterally in the circular portion 720 by the neck 724. The head portion 622 of the actuator 620 engages one side of the forked portion 712*b* of the bridge 712 about the circular aperture 616 and the unthreaded portion 626 extends though the circular aperture 616 for free rotation. The threaded shaft portion 624 and the head portion 622 of the actuator 620 maintain longitudinally the unthreaded portion 626 in the circular aperture 616. The head portion 622 is generally against a first side 726 of the forked portion 712*b* of the bridge 712 and the threaded shaft portion 624 is generally against a second side 728 of the forked portion 712*b*.

More specifically, with the diameter of the circular portion 720 slightly larger than the diameter of the unthreaded portion 626, the actuator 620 is able to rotate relatively freely in the circular aperture 616 without moving longitudinally relative to the bridge 712 because of the head portion 622 and the threaded shaft portion 624. Further, threads near the end of the threaded shaft portion 624 may be deformed after connection to the base 312 of the grounding connector 310 to prevent the ground terminal 314 from becoming separated from the base 312. As a result, the grounding connector 310 becomes a one-piece captivated connector. The components of the ground terminal 314 may be made from any suitable electrically conductive material, such as 0.045" stiff temper brass.

The guides 358 of the bracket 326 are received in the guide apertures 362 of the top planar portion 324 of the base 312. The clearance between the guides 358 and the guide apertures 362 is preferably only that which is needed to facilitate smooth movement of the guides 358 relative to the top planar portion 324. The actuator 328 threads into the threaded bushing 346 mounted in the aperture 344 of the top planar portion 324. The actuator 328 extends only slightly beyond the guides 358 to accommodate the thickness of the bushing 346 and to allow most, if not all, of the U-shaped apertures 360 to be exposed to facilitate the insertion of a ground wire without releasing the actuator from the bushing 346.

However, the actuator 328 should not extend too far beyond the guides 358 in order to avoid undesired contact between the actuator 328 and the structure to which the grounding connector 310 is connected. More specifically, the length of the front planar portion 316 of the base 312 and the fastener 334 is coordinated with the length of the actuator 328 and the guides 358 so as to provide sufficient clearance between the top planar portion 324 and the structure to which the connector 310 is connected to allow the actuator 328 to operate. That is, for example, the actuator 328 is turned counter-clockwise to move the bridge 356 of the bracket 326 away from the top planar portion 324 to expose the U-shaped apertures 360 for receiving a grounding wire and is turned clockwise to move the bridge 356 toward the top planar portion 324 to secure a grounding wire between the bridge 356 and top planar portion 324. The front planar portion 316 and the fastener 334 should be long enough to allow the actuator 328 to move between the wire receiving and wire engaging position without contacting the structure to which the connector 310 is attached. Contact with the structure to which the connector 310 is attached could cause damage to the grounding connector 310 or could cause the connection of a grounding wire to the grounding connector 310 to be compromised. Additionally, it is preferable to minimize the overall height of the ground terminal 314 so as to produce a "low-profile" grounding connector 310 which minimizes the potential for breakage of the ground terminal 314 when struck by an object after installation.

As mentioned previously, the grounding connector 310 includes the securing fastener 334 in the form of a screw or bolt to aid in attaching and securing the connector 310 to the structure to which it is attached. An end portion 338 of the fastener 334 includes an end surface 340 of sufficient roughness, or other end structure for engaging the structure to which the connector 310 is attached, to abrade the outer surface of the structure without piercing into the inside of the structure. For example, as illustrated, the top portion 324 includes the aperture 330 that receives the threaded fastener 334. The fastener 334 is preferably fine-threaded to permit a greater amount of rotational or turning motion against the structure to which the connector 310 is attached. The fastener 334 may be formed of any suitable electrically conductive material, such as heat-treated beryllium copper alloy.

Figure 23:
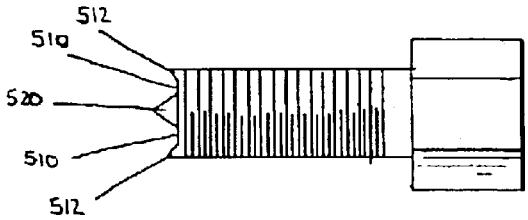
FIG. 23 is a side elevational view of the fastener of the grounding connectors of FIGS. 16 and 19.
Figure 24:
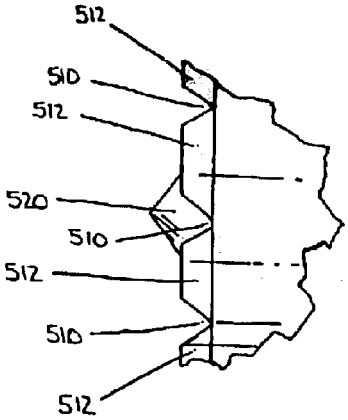
FIG. 24 is an enlarged, partial elevational view of the fastener of FIG. 23.
Figure 25:
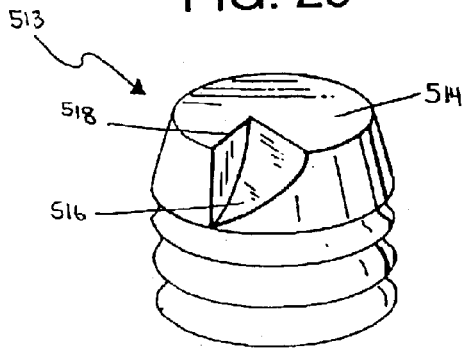
FIG. 25 is an enlarged, partial perspective view of an alternative fastener contemplated by the present invention.

More specifically, by way of example, the end surface 340 may include grooves 510 and ridges 512, as depicted in FIGS. 23 and 24. Also, depending on the hardness of the material to which the connector 310 is to be applied, conventional machining techniques used in the fabrication of fasteners may provide a surface somewhere on the terminal end 340 of the fastener 334 of sufficient roughness to grind through the material of the structure, and in this case, there would be no grooves and ridges. This would include an end surface 340 that is relatively smooth in nature, but would still have the ability to cut through the surface upon rotation to form an electrical connection to the material. In addition, other terminal end configurations designed to score or cut, such as a knife-like end 514 of a fastener 334 illustrated in FIG. 25, may be employed. The knife-like end 514 has a longitudinal cut out 516 that provides an edge 518 that grinds through the outer surface of the structure without penetrating to the inside of the structure.

As illustrated, a center point 520 may be provided at the terminal end 338 to engage the outer surface of the structure to which the connector 310 is attached first to resist inadvertent movement or "walking" of the connector 310 as it is being secured to the structure. The center point 520 is preferably of a generally conical shape, wherein the surface of the cone has sufficient roughness to grind through the outer surface of the structure without penetrating to the inside of the structure. However, the center point 520 may take the form of various other shapes so long as such shapes resist "walking" during installation.

Opposite the terminal end, the fastener 334 includes a hexagonal shaped head 336, which can be used to turn the fastener 334 for installing and securing the connector 310. More specifically, a tool, such as a torque wrench, can be used to grip the hexagonal head 336 and turn the fastener 334 with the appropriate amount of torque. For example, a torque in the range of about 20 to 25 inch/pounds may be used as the tightening torque in attaching the connector.

As the head 336 of the fastener 334 is turned to secure the connector 310 to the structure to which it is attached the center point 520, if present, contacts the structure before the end surface 340 and first begins to penetrate and abrade the outer surface of the structure. As the fastener 334, or knife-like fastener 513, is rotated, the end surface 340 rotates into engagement to penetrate the outer surface of the structure. The end surface 340 has sufficient roughness, or other structures such as the knife-like cutting configuration, to abrade, cut and/or scrape the paint or other coating covering the outside surface of the structure. As a result, an electrical connection is made between the fastener 334 and the structure. The center point, 520, if present, provides the additional feature of holding the fastener 334 against inadvertent movement or "walking" as the end surface 340 is abrading, cutting, and/or scraping the surface of the structure.

Threads 342 near the end of the threaded shaft portion 338 may be deformed to prevent the removal of the fastener 334 from the base 312. As a result, the grounding connector 310 becomes a one-piece captivated connector.

The grounding connector 310 may be attached to any planar member, such as the lid of a metal utility box. Typically, an extending metal plate, such as a depending flange or lip extends down from a utility box and provides a suitable planar member for connecting the grounding connector 310. The utility box generally is coupled to the ground via a separate grounding wire and grounding rod in order to be electrically grounded. Such a utility box is typically painted or has other coatings covering the box for preventing the corrosion of or the leakage of moisture into the inside of the box. It is also common for dirt and/or corrosion to form on the outside surfaces of the utility box. The grounding connector 310 forms a mechanical and electrical connection to the metal of the utility box lip.

In most cases, the lip of the utility box is close to a wall of the utility box, and thus, there is limited space available to connect the grounding connector 310. For example, a wall may be located closely adjacent to the lip and provides a narrow and restricted gap between the lip and the wall. The grounding connector 310 is constructed in such a way to allow the connector 310 to be utilized in restricted spaces such as these. That is, the hook 322 is sufficiently thin in order for it to be inserted into the gap. However, the space between the front planar portion 316 and the rear straight portion 318 is sufficient to allow the desired structure to fit therebetween.

To form a connection to the structure to which the connector 310 is to be attached, typically a grounded utility box, the grounding connector 310 is positioned at a lip of the structure so that the hook 322 reaches under the lip into the space between the lip and the base structure. Then, the fastener 334 is rotated within the aperture 330 so as to lower the end surface 340 into abutment with the structure. The center point, if present, penetrates the outer surface of the structure. The center point, if present, resists inadvertent movement or "walking" of the grounding connector 310 as the fastener 334 is tightened. As the rotation of the fastener 334 continues, the abrading end surface 340 grinds, cuts, or scores the coating or paint of the surface and mechanically and electrically connects the grounding connector 310 to the structure.

After the fastener 334 is secured, a grounding wire may be inserted into the ground terminal 314 through the U-shaped apertures 360 under the planar bridge 356. The grounding wire may come from any type of grounding connector utilizing a grounding wire, including those discussed supra.

Referring to FIGS. 19–22, there is illustrated an alternate grounding connector 410 embodying features of the present invention. The grounding connector 410 includes a base 412 that supports a ground terminal 414. The ground terminal 414 is designed to receive and secure a grounding wire to the grounding connector 410 to form an electrical connection between the grounding connector 410 and a grounding wire. The opposite end of the grounding wire can be attached to anything requiring grounding, such as a second grounding connector, including those described supra. The grounding connector 410 may be made of any suitable conductive material, and thus, the grounding wire is grounded along with the grounding connector 410. The grounding connector 410 is designed to be mechanically and electrically attached to the surface of a grounded object, such as a grounded utility box.

The grounding connector 410 includes a base 412 having a generally U-shaped configuration. The U-shaped configuration is formed from three portions or members 416, 418, and 420. More specifically, the first member is a front planar portion 416 which extends generally perpendicular to the second member which is a base portion 420 located at the bight or bottom of the U-shaped configuration. The third member is a rear or brace planar portion 418 that extends upward from the base portion 420. The front 416 and rear 418 planar portions are not parallel, but incline together as will be explained. In the center of the front planar portion 416, a threaded opening 430 extends axially through the front planar portion 416 and is located opposite the rear planar portion 418. Preferably, the center axis of the opening 430 is located so that the rear portion 418 extends slightly above the opening 430. The base 412 may be made from any suitable conductive material, such as 0.048" CR spring steel material, such as SAE 4130 or 8630, which has been heat treated to a hardness of 46 Rockwell C.

The front planar portion 416, preferably, remains generally rigid and stationary. To add support to the front planar portion 416, a pair of support ribs or flanges 468 are located along each side of the front planar portion 416. Each rib 468 has a generally L-shaped configuration with a front portion 478 against the front planar portion 416 and a side portion 480 of generally a triangular configuration that extends between the front portion 478 and the base portion 420. The side portion 480 includes an angled edge 472, which is preferably at an angle that disposes it generally parallel to the rear planar portion 418 as may be seen in FIG. 22. The bottom of the support ribs 468 are welded to the base member 420 or, alternatively, may be formed by members bent upward and forward from a single piece of material. Each rib 468 extends rearward to an edge rib surface 470, which is generally parallel to the front planar portion 416.

The rear straight portion 418, preferably, is a stiff steel spring leaf which is resiliently movable. When pressure is applied, such as during installation, it will deflect rearward and open or widen the top opening. As a result, the rear planar portion 418 moves to a position generally parallel with the front planar portion 416. Although a resiliently movable rear planar portion 418 is preferable, it may also be designed, through material selection and/or structural configuration, such that it remains fixed.

Figure 22:
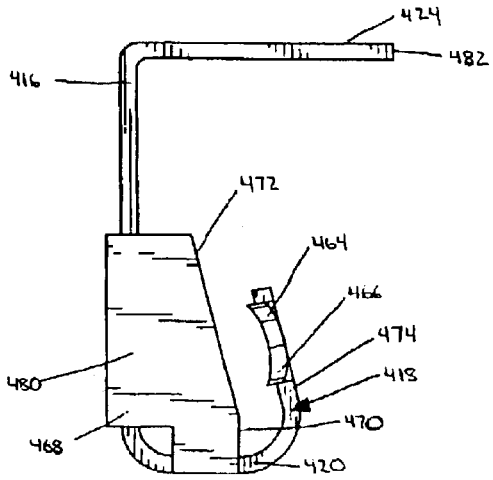
FIG. 22 is a side elevational view of the base of FIG. 20.

As best seen in FIG. 22, the rear straight portion 418 may include a plurality of projections or barbs 464 and 466 which extend forward toward the front planar portion 316. The thin straight portion 418 is generally rectangular with a pair of side edges 474 and a top edge 476 located above the threaded aperture 430. A pair of upper projections 464 is formed in the side edges 474 and extends toward the front planar portion 416. A pair of lower projections 466 is formed below the upper projections 464 and also project toward the front planar portion 416. These butterfly-shaped projections 464 and 466 may be formed by stamping the rear planar portion 418 to cause the material near the side edges 474 to project forward toward the front planar portion 416. The upper 464 and lower 466 projections are spaced apart a maximum distance corresponding to the width of the rear planar portion 418. The projections 464 and 466 aid in resisting inadvertent movement of the connector 410 during installation and also aid in forming an electrical contact with the structure to which the connector 410 is being attached by biting through the surface. The base 412 and the fastener 434 are also discussed in detail in U.S. Pat. Nos. 5,928,006 and 5,746,609, which are incorporated by reference herein.

A support platform 424 supports and cooperates with the ground terminal 414 to secure a grounding wire. The ground terminal 414 includes a bracket 426 and an actuator 428 to move the bracket 426 between a wire receiving position and a wire engaging position. That is, the actuator 428 positions the bracket 426 so that the bracket 426 secures a grounding wire to the grounding connector 410. The grounding connector 410 is designed to provide clearance for the ground terminal 414 to operate effectively when shifting between the wire receiving and wire engaging positions.

As mentioned above, the support platform 424 cooperates with the ground terminal 414 to attach an appropriate grounding wire to the grounding connector 410. The support platform 424 forms an angle of about ninety (90) degrees with the front planar portion 416 of the base 412. The support platform 424 defines a pair of elongated guide apertures 462. The guide apertures 462 are spaced from one another and run parallel to each other. The guide apertures 462 are also generally rectangular in shape and are set perpendicular to the rear edge 482 of the support platform 424. This configuration facilitates the association of a grounding wire with the ground terminal 414 and the operation of the ground terminal 414. The support platform 424 also defines a circular aperture 444 partially between the guide apertures 462. The aperture 444 may be threaded or fitted with a threaded bushing 446 to cooperate with a screw or bolt. The guide apertures 462 and the circular aperture 444 are located generally in the center of the support platform 424, with the aperture 444 closer to the front planar portion 416 and the guide apertures 462 closer to the rear edge 482 of the support platform 424.

Figure 19:
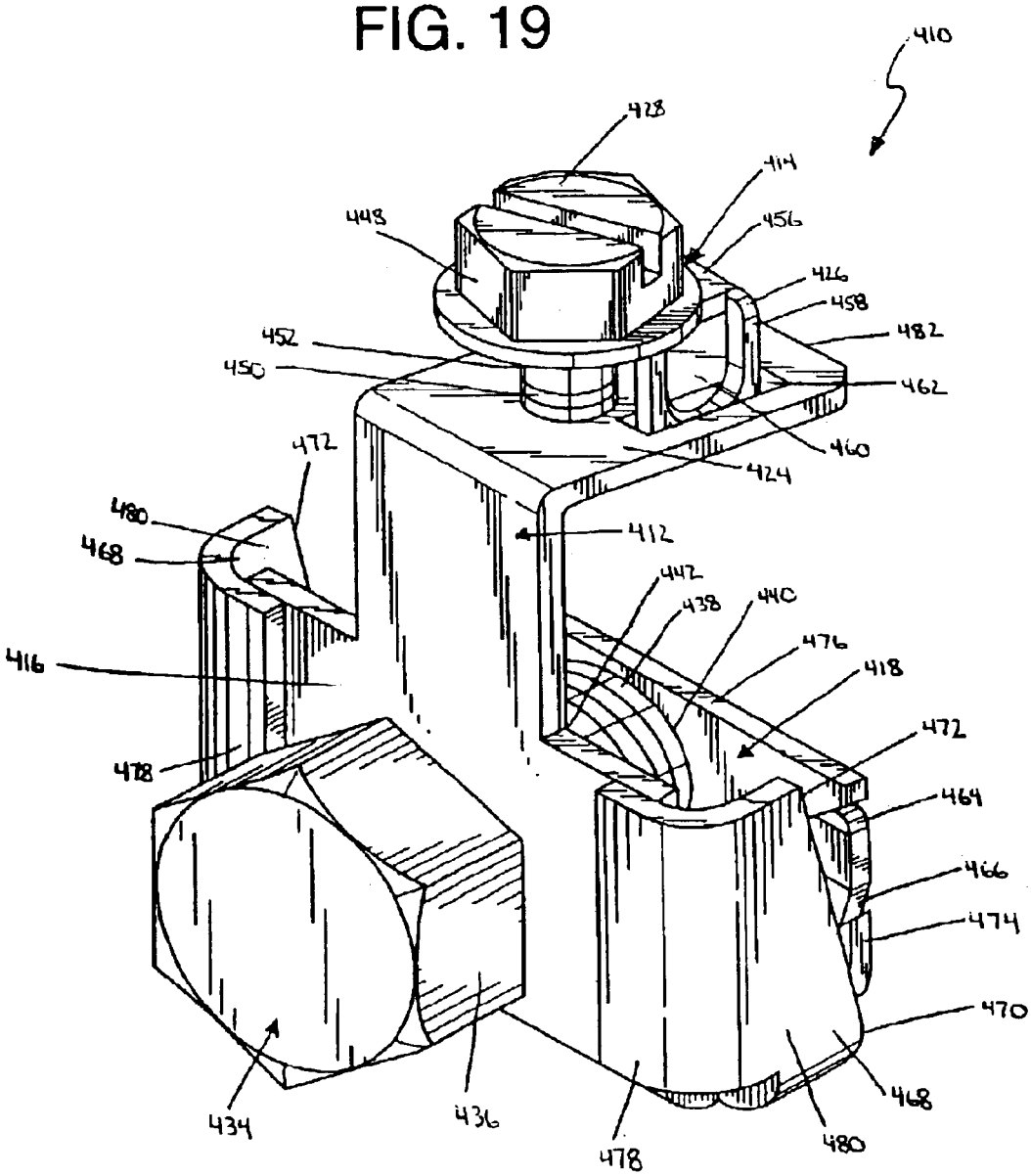
FIG. 19 is a perspective view of another alternate grounding connector embodying features of the present invention.
Figure 20:
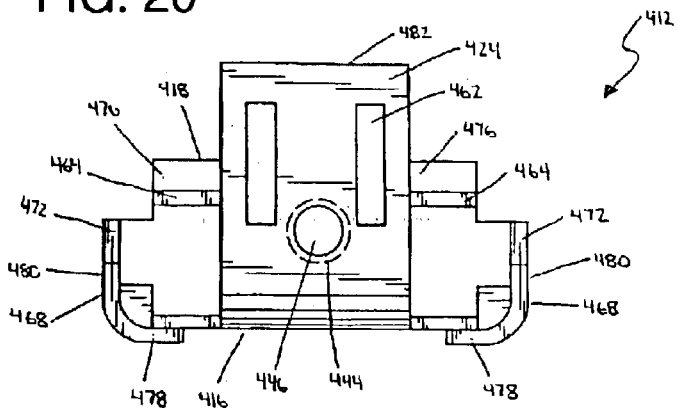
FIG. 20 is a plan view of the base of the grounding connector of FIG. 19.
Figure 21:
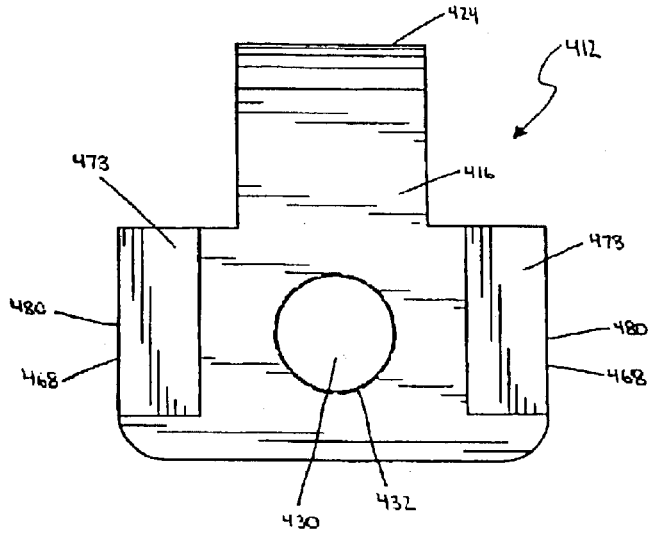
FIG. 21 is a rear elevation view of the base of FIG. 20.

As previously mentioned, the ground terminal 414 includes the bracket 426 and the actuator 428. With reference to FIG. 19, the bracket 426 includes a generally planar bridge 456 with a generally square portion and an arcuate portion. The bracket 426 also includes a pair of guides 458 interconnected by the planar bridge 456 of the bracket 426. The guides 458 extend from opposite edges of the planar bridge 456 and form an angle of about ninety (90) degrees with the planar bridge 456. Each guide 458 defines a U-shaped aperture 460 that is designed to receive a ground wire. The U-shaped apertures 460 are spaced by the arcuate portion from the actuator 428 so the ground wire does not interfere with the actuator 428 and are aligned so that a ground wire may readily pass through both apertures 460.

The arcuate portion of the planar bridge 456 of the bracket 426 defines a circular aperture through which the actuator 428 extends. The illustrated actuator 428 is in the form of a bolt with a hexagonal head portion 448 having a slot for use with different types of tools. However, many other various head configurations may be used in place of the hexagonal head portion 448. The actuator 428 also includes a threaded shaft portion 450. A different type of device, such as a thumbscrew or screw, including a sheet metal screw or machine screw, may be employed as the actuator 428 in place of the bolt.

The head portion 448 engages one side of the arcuate portion of the bridge 456 about the circular aperture, and the threaded shaft 450 extends through the circular aperture. To maintain the shaft 450 in the circular aperture with the head portion 448 generally against the arcuate portion of the bridge 456, one or more threads 452 adjacent to the other side of the bridge may be deformed. The diameter of the circular aperture is slightly larger than the diameter of the threaded shaft portion 450, such that the actuator 428 is able to rotate freely within the aperture without moving relative to the bridge 456 because it is held in place by the head portion 448 and the deformed threads 452. Further, threads 454 near the end of the threaded shaft portion 450 may be deformed to prevent the removal of the ground terminal 414 from the base 412. As a result, the grounding connector 410 becomes a one-piece captivated connector. The components of the ground terminal 414 may be made from any suitable electrically conductive material, such as 0.045" stiff temper brass.

Alternatively, the head portion 448 of the actuator 428 is cold formed and the remaining shaft portion for the actuator 428 is inserted through the circular aperture of the bracket 426. Threads are then formed on the shaft portion to form the threaded shaft 450. The threading is not done on the shaft portion extending through the aperture and is larger in diameter than the circular aperture. Thus, the threaded shaft 450 is allowed to rotate relatively freely in the aperture, and the threading prohibits the actuator 428 from moving longitudinally relative to the bridge 456.

In another alternative form, as shown in FIG. 7, the bracket 608 includes a generally planar bridge 610 with a generally square portion 610*a* and a forked portion 610*b*. The bracket 608 also includes a pair of guides 612 interconnected by the generally square portion 610*a* of the bracket 608. The guides 612 extend from opposite edges of the square portion 610*a* and are generally ninety (90) degrees to the square portion 610*a*. Each guide 612 defines a U-shaped aperture 614 that is designed sufficiently larger than the desired ground wire to facilitate easy receipt of such wire. The U-shaped apertures 614 are aligned so that the ground wire can readily pass through both.

The forked portion 610*b* of the bracket 608 defines slot with a circular portion 616 and a tapered passage 618. The tapered passage 618 leads to the circular portion 616 and opens opposite the square portion 610*a* of the bridge 610. The intersection of the tapered portion 618 and the circular portion 616 forms a neck 632. The forked portion 610*b*, and the circular portion 616 of the slot locate the actuator 620 so as not to be interfered with by a grounding wire extending through the U-shaped apertures 614.

The illustrated actuator 620 is in the form of a bolt with a head portion 622 and a threaded shaft portion 624. The head portion 622 may include a hexagonal configuration and a slot for use with a variety of tools. The actuator 620 also includes an unthreaded portion 626 located between the head portion 622 and the threaded shaft portion 624. The unthreaded portion 626 has a diameter slightly smaller than the threaded shaft portion 624. Other devices, such as a thumbscrew or screw, including a sheet metal screw or machine screw, may be formed with the unthreaded portion 626 adjacent the head portion 622 and be employed as the actuator 620, as well as other head configurations for use with different tools.

To assemble the ground terminal 414, the unthreaded portion 626 is inserted into the tapered portion 618 and is moved toward the circular portion 616. The edges of the tapered portion 618 guide the movement for installation of the actuator 620 to the neck 632. The unthreaded portion 626 forces the tapered portion 618 to expand outward, which in turn allows the unthreaded portion 626 to snap through the neck 632 into place within the circular portion 616. The unthreaded portion 626 is maintained laterally in the circular portion 616 by the neck 632. The head portion 622 engages one side of the forked portion 610*b* of the bridge 610 about the circular aperture 616 and the unthreaded portion 626 extends through the circular aperture 616 for free rotation. The threaded shaft portion 624 and the head portion 622 of the actuator 620 maintain longitudinally the unthreaded portion 626 in the circular aperture 616. The head portion 622 is generally against a first side 628 of the forked portion 610*b* of the bridge 610 and the threaded shaft portion 624 is generally against a second side 630 of the forked portion 610*b*.

More specifically, with the diameter of the circular portion 616 slightly larger than the diameter of the unthreaded portion 626, the actuator 620 is able to rotate relatively freely in the aperture 616 without moving longitudinally relative to the bridge 610 because of the head portion 622 and the threaded shaft portion 624. Further, threads near the end of the threaded shaft portion 624 may be deformed after connection to the base 412 of the grounding connector 410 to prevent the ground terminal 414 from becoming separated from the base 412. As a result, the grounding connector 410 becomes a one-piece captivated connector. The components of the ground terminal 414 may be made from any suitable electrically conductive material, such as 0.045" stiff temper brass.

In yet another alternative form, as shown in FIGS. 8 and 9, the bracket 710 includes a generally planar bridge 712 with a generally square portion 712*a* and a forked portion 712*b*. The bracket 710 also includes a pair of guides 714 interconnected by the generally square portion 712*a* of the bracket 710. The guides 714 extend from opposite edges of the square portion 712*a* and are generally ninety (90) degrees to the square portion 712*b*. Each guide 714 defines an aperture 716 that is designed sufficiently larger than the desired ground wire to facilitate easy receipt of such wire.

More specifically, the aperture 716 includes a generally U-shaped portion 716*a* located opposite the planar bridge 712 and a generally V-shaped portion 716*b* generally adjacent the planar bridge 712. The U-shaped portion 716*a* and the V-shaped portion 716*b* intersect in generally the middle of the length of the guide 714. The V-shaped portion 716*b* may have a flattened base 718. The flattened base 718 may have various dimensions that maintain the V-shape of the V-shaped portion 716*b* but, preferably, has dimensions smaller than the diameter of a 14 gauge wire.

The V-shaped portion 716*b* of the aperture 716 is designed with dimensions such that the aperture 716 contacts the ground wire on each side of the ground wire. As such, the ground wire cannot move or pivot relative to the aperture 716 and the edges of the aperture 716 hold the ground wire under high pressure on both sides of the ground wire. The apertures 716 are aligned so that the ground wire can readily pass through both. Although in the present alternative form, the aperture 716 includes a generally U-shaped portion 716*a* and a generally V-shaped portion 716*b*, any shape that increases the pressure on the ground wire and discourages movement or pivoting of the ground wire while allowing the ground wire to be inserted with ease may be used.

In addition, the bracket may be formed with any additional structural features anywhere thereon that applies an increased pressure on the grounding wire. For example, the square portion 712*a* may have a portion that extends into the area between the guides 714. That is, the square portion 712*a* could be stamped to push a portion into the area between the guides 714. This portion engages the grounding wire to provide increased binding pressure on the wire.

The forked portion 712*b* of the bracket defines a slot with a circular portion 720 and a tapered passage 722. The tapered passage 722 leads to the circular portion 720 and opens opposite the square portion 712*a* of the bridge 712. The intersection of the tapered passage 722 and the circular portion 720 forms a neck 724. The forked portion 712*b* and the circular portion 720 of the slot locate the actuator 620, as discussed above, so as not to be interfered with by a grounding wire extending through the aperture 716.

To assemble the ground terminal 414, the unthreaded portion 626 of the actuator 620 is inserted into the tapered passage 722 and is moved toward the circular portion 720. The edges of the tapered passage 722 guide the movement of the actuator 620 to the neck 724. The unthreaded portion 626 forces the tapered passage 722 to expand outward, which in turn allows the unthreaded portion 626 to snap through the neck 724 into place within the circular portion 720. The unthreaded portion 626 is maintained laterally in the circular portion 720 by the neck 724. The head portion 622 of the actuator 620 engages one side of the forked portion 712*b* of the bridge 712 about the circular aperture 616 and the unthreaded portion 626 extends though the circular aperture 616 for free rotation. The threaded shaft portion 624 and the head portion 622 of the actuator 620 maintain longitudinally the unthreaded portion 626 in the circular aperture 616. The head portion 622 is generally against a first side 726 of the forked portion 712*b* of the bridge 712 and the threaded shaft portion 624 is generally against a second side 728 of the forked portion 712*b*.

More specifically, with the diameter of the circular portion 720 slightly larger than the diameter of the unthreaded portion 626, the actuator 620 is able to rotate relatively freely in the circular aperture 616 without moving longitudinally relative to the bridge 712 because of the head portion 622 and the threaded shaft portion 624. Further, threads near the end of the threaded shaft portion 624 may be deformed after connection to the base 412 of the grounding connector 410 to prevent the ground terminal 414 from becoming separated from the base 412. As a result, the grounding connector 410 becomes a one-piece captivated connector. The components of the ground terminal 414 may be made from any suitable electrically conductive material, such as 0.045" stiff temper brass.

The guides 458 of the bracket 426 are received in the guide apertures 462 of the support platform 424 of the base 412. The clearance between the guides 458 and the guide apertures 462 is preferably only that which is needed to facilitate smooth movement of the guides 458 relative to the support platform 424. The actuator 428 threads into the threaded bushing 446 mounted in the aperture 444 of the support platform 424. The actuator 428 extends only slightly beyond the guides 458 to accommodate the thickness of the bushing 446 and to allow most, if not all, of the U-shaped apertures 460 to be exposed to facilitate the insertion of a ground wire without releasing the actuator 428 from the bushing 446.

However, the actuator 428 should not extend too far beyond the guides 458 in order to avoid undesired contact between the actuator 428 and the structure to which the grounding connector 410 is connected. More specifically, the length of the front planar portion 416 is coordinated with the length of the actuator 428 and the guides 458 so as to provide sufficient clearance between the support platform 424 and the structure to which the connector 410 is connected for the actuator 428 to operate effectively. That is, for example, the actuator 428 is turned counter-clockwise to move the bridge 456 of the bracket 426 away from the support platform 424 to expose the U-shaped apertures 460 for receiving a grounding wire and is turned clockwise to move the bridge 456 toward the support platform 424 to secure a grounding wire between the bridge 456 and the support platform 424. The front planar portion 416 should be long enough to allow the actuator 428 to move between the wire receiving and wire engaging positions without contacting the structure to which the connector 410 is attached. Contact with the structure to which the connector 410 is attached could cause damage to the grounding connector 410 or could cause the connection of a grounding wire to the grounding connector 410 to be compromised. Additionally, it is preferable to minimize the overall height of the ground terminal 414 so as to produce a "low-profile" grounding connector 410 which minimizes the potential for breakage of the ground terminal 414 when struck by an object after installation.

As mentioned previously, the grounding connector 410 includes the securing fastener 434 in the form of a screw or bolt to aid in attaching and securing the connector 410 to the structure to which it is attached. An end portion 438 of the fastener 434 includes an end surface 440 of sufficient roughness, or other end structure for engaging the structure to which the connector 410 is attached, to abrade the outer surface of the structure without piercing into the inside of the structure. For example, as illustrated, the front planar portion 416 includes the aperture 430 that receives the threaded fastener 434. The fastener 434 is preferably fine-threaded to permit a greater amount of rotational or turning motion against the structure to which the connector 410 is attached. The fastener 434 may be formed of any suitable electrically conductive material, such as heat-treated beryllium copper alloy.

More specifically, by way of example, the end surface 440 may include grooves 510 and ridges 512, as depicted in FIGS. 23 and 24. Also, depending on the hardness of the material to which the connector 410 is to be applied, conventional machining techniques used in the fabrication of fasteners may provide a surface somewhere on the terminal end 440 of the fastener 434 of sufficient roughness to grind through the material of the structure, and in this case, there would be no grooves and ridges. This would include an end surface 440 that is relatively smooth in nature, but would still have the ability to cut through the surface upon rotation to form an electrical connection to the material. In addition, other terminal end configurations designed to score or cut, such as a knife-like end 514 of a fastener 434 illustrated in FIG. 25, may be employed. The knife-like end 514 has a longitudinal cut out 516 that provides an edge 518 that grinds through the outer surface of the structure without penetrating to the inside of the structure.

As illustrated, a center point 520 may be provided at the terminal end 338 to engage the outer surface of the structure to which the connector 410 is attached first to resist inadvertent movement or "walking" of the connector 410 as it is being secured to the structure. The center point 520 is preferably of a generally conical shape, wherein the surface of the cone has sufficient roughness to grind through the outer surface of the structure without penetrating to the inside of the structure. However, the center point 520 may take the form of various other shapes so long as such shapes resist "walking" during installation.

Opposite the terminal end, the fastener 434 includes a hexagonal shaped head 436, which can be used to turn the fastener 434 for installing and securing the connector 410. More specifically, a tool, such as a torque wrench, can be used to grip the hexagonal head 436 and turn the fastener 434 with the appropriate amount of torque. For example, a torque in the range of about 20 to 25 inch/pounds may be used as the maximum tightening torque in attaching the connector.

As the head 436 of the fastener 434 is turned to secure the connector 410 to the structure to which it is attached the center point 520, if present, contacts the structure before the end surface 440 and first begins to penetrate and abrade the outer surface of the structure. As the fastener 434, or knife-like fastener 513, is rotated, the end surface 440 rotates into engagement to penetrate the outer surface of the structure. The end surface 440 has sufficient roughness, or other structures such as the knife-like cutting configuration, to abrade, cut and/or scrape the paint or other coating covering the outside surface of the structure. As a result, an electrical connection is made between the fastener 434 and the structure. The center point, 520, if present, provides the additional feature of holding the fastener 434 against inadvertent movement or "walking" as the end surface 440 is abrading, cutting, and/or scraping the surface of the structure.

Threads 442 near the end of the threaded shaft portion 438 may be deformed to prevent the removal of the fastener 434 from the base 412. As a result, the grounding connector 410 becomes a one-piece captivated connector.

The grounding connector 410 may be attached to any planar member, such as the lid of a metal utility box. Typically, an extending metal plate, such as a depending flange or lip extends down from a utility box and provides a suitable planar member for connecting the grounding connector 410. The utility box is generally coupled to the ground via a separate grounding wire and grounding rod. Such a utility box is typically painted or has other coatings covering the box for preventing the corrosion of or the leakage of moisture into the inside of the box. It is also common for dirt and/or corrosion to form on the outside surfaces of the utility box, depending upon the age of the box. The grounding connector 410 forms a mechanical and electrical connection to the metal of the utility box lip.

In most cases, the lip of the utility box is close to a wall of the utility box, and thus, there is limited space available to connect the grounding connector 410. For example, a wall may be located closely adjacent to the lip and provides a narrow and restricted gap between the lip and the wall. The grounding connector 410 is constructed in such a way to allow the connector 410 to be utilized in restricted spaces such as these. That is, the rear planar portion 418 is sufficiently thin so as to be capable of being inserted into the gap. Further, the rear planar portion 418 slants toward the front planar portion 416 as may be seen in FIG. 22. However, the space between the rear planar portion 418 and the front planar portion 416 is sufficient to allow the desired structure to fit therebetween.

To form a connection to the structure to which the connector 410 is to be attached, such as a utility box, the grounding connector 410 is positioned over a lip of the structure so that the U-shaped space defined by the portions 416, 418, and 420 receives the lip. The plurality of projections 464 and 466 initially space the interior side of the lip away from the remainder of the rear planar portion 418. Then, the fastener 434 is rotated within the aperture 430 so as to lower the end surface 440 into abutment with the lip. The projections 464 and 466 of the rear planar member 418, as well as the center point 520, if present, penetrate the outer surface to resist inadvertent movement or "walking" of the grounding connector 410 as the fastener 434 is tightened. In addition to mechanically clamping the connector 410 to the structure, the rotation of the fastener 434 also causes the abrading surface 440 to grind, cut, or score the paint and/or any other coating on the structure and to electrically connect the grounding connector 410 to the structure. Depending upon the application for and the structure and material of the connector 410, there may be a certain desired torque to be applied to the fastener 434. For example, such torque may be in the range of 20–30 inch pounds.

After the fastener 434 is set as desired, a grounding wire may be inserted into the ground terminal 414 through the U-shaped apertures 460 and the planar bridge 456. The grounding wire may come from any service needing a ground connection and any type of grounding connector utilizing a grounding wire, such as those discussed supra.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

I claim:

1. A grounding connector comprising:

an electrically conductive base, the base defining at least one guide aperture;

a bracket being configured and sized relative to the base for receiving and securing a wire from a group of wires having a range of sizes for electrical connection to the base;

an actuator for moving the bracket between a wire receiving position and a wire engaging position, at least a portion of the bracket receivable in the at least one guide aperture of the base to guide the movement of the bracket between the wire receiving and wire engaging positions; and the at least a portion of the bracket receivable in the guide aperture having at least one clamping surface profiled to apply increased pressure to a wire for enhanced securement.

2. A grounding connector in accordance with claim 1 wherein the bracket includes at least one guide that defines the at least one aperture capable of receiving a wire.

3. A grounding connector in accordance with claim 1 further comprising at least one interconnector electrically connected to the base and capable of interconnecting at least two cables or wires.

4. A grounding connector in accordance with claim 3 wherein the interconnector includes an F-series-type connector.

5. A grounding connector in accordance with claim 1 wherein the base includes a first portion and a second portion and one of the first and second portions supports the bracket in a position to facilitate moving.

6. A grounding connector in accordance with claim 5 wherein the base includes at least one spacer that interconnects the first and second portions.

7. A grounding connector in accordance with claim 6 wherein the first and second portions of the base are parallel to one another and the first portion supports the bracket, the second portion is to mount the connector, and the spacer locates the bracket in position to facilitate moving of the bracket between the wire receiving and engaging positions.

8. A grounding connector in accordance with claim 7 wherein the spacer is disposed at an angle of generally ninety degrees to the first and second portions of the base.

9. A grounding connector in accordance with claim 1 wherein the bracket defines at least one aperture capable of receiving a wire from a group of wires having a range of wire sizes when the bracket is in the wire receiving position and the bracket clamps the wire at the base when moved to the wire engaging position.

10. A grounding connector in accordance with claim 9 wherein the at least one clamping surface is located at the at least one aperture to provide increased securing pressure when the bracket is in the wire engaging position.

11. A grounding connector in accordance with claim 10 wherein the at least one clamping surface defines at least a portion of the at least one aperture.

12. A grounding connector in accordance with claim 11 wherein the at least one clamping surface is configured to position a wire.

13. A grounding connector in accordance with claim 1 wherein the base has at least two guide apertures and the bracket includes at least two guides.

14. A grounding connector in accordance with claim 13 wherein each of the at least two guides defines an aperture capable of receiving a wire when the bracket is in the wire receiving position and the bracket clamps the wire at the base when shifted to the wire engaging position.

15. A grounding connector in accordance with claim 14 wherein the at least one clamping surface is located at each aperture to clamp the wire at the base with increased pressure.

16. A grounding connector in accordance with claim 15 wherein the aperture has a surface designed to provide positioning of the wire.

17. A grounding connector in accordance with claim 14 wherein the bracket includes at least two guides and at least one spacer interconnecting and spacing the at least two guides.

18. A connector comprising:

a base defining an aperture;

a bracket secured to the base for movement between a first position and a second position, the bracket having an arm that extends through the aperture, the arm including a space therethrough and being configured to receive a ground wire in the space; and a fastener secured to the base and positioned to drive the bracket between the first and second positions.

19. A connector in accordance with claim 18 wherein the fastener secures the bracket to the base.

20. A connector in accordance with claim 19 wherein the fastener includes threads engaging the base, a portion of the threads being damaged to prevent removal of the fastener and bracket from the base.

21. A method of mounting a ground wire comprising:

mounting a connector to a mounting surface;

inserting a ground wire through a space extending through a bracket of the connector; and moving the bracket to a wire securing position to thereby clamp the wire between the bracket and a base of the connector, wherein the bracket is movable relative to the base but is not removable from the base.

* * * * *